US011051629B1

(12) United States Patent
Leach

(10) Patent No.: US 11,051,629 B1
(45) Date of Patent: Jul. 6, 2021

(54) ADJUSTABLE BODY PILLOW

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 368 days.

(21) Appl. No.: 15/898,479

(22) Filed: Feb. 17, 2018

Related U.S. Application Data

(60) Provisional application No. 62/460,982, filed on Feb. 20, 2017.

(51) Int. Cl.
*A47C 20/00* (2006.01)
*A47C 20/02* (2006.01)

(52) U.S. Cl.
CPC ..... *A47C 20/026* (2013.01); *A47C 20/021* (2013.01); *A47C 20/027* (2013.01)

(58) Field of Classification Search
CPC ..... A47D 13/08; A47C 20/20
USPC ..... 5/632, 630, 655
See application file for complete search history.

(56) References Cited

U.S. PATENT DOCUMENTS 682,871 A 9/1901 Hogan et al.
726,164 A 4/1903 Hogan et al.
D124,296 S 12/1940 Thompson
2,336,707 A 12/1943 Thompson
2,795,802 A 6/1957 Myers
2,953,793 A 9/1960 Rossi
D201,492 S 6/1965 Jacobson
3,327,330 A 6/1967 McCullough
3,899,797 A 8/1975 Gunst
4,173,048 A 11/1979 Varaney
4,236,264 A 12/1980 Britzman
4,506,396 A 3/1985 Ritchie et al.
D299,988 S 2/1989 Parabita
4,834,459 A 5/1989 Leach
4,861,109 A 8/1989 Leach
D303,897 S 10/1989 Phillips
4,872,228 A 10/1989 Bishop
D309,018 S 7/1990 Leach
5,026,315 A 6/1991 Chap
D318,969 S 8/1991 Byrn
5,103,514 A 4/1992 Leach
5,154,649 A 10/1992 Pender
5,325,818 A 7/1994 Leach
5,359,739 A 11/1994 Raines et al.
5,519,906 A 5/1996 Fanto-Chan
(Continued)

OTHER PUBLICATIONS

The Leachco Two-By-You product shown in the packaging material attached as Exhibit 1 was in public use and/or on sale at least since about Oct. 12, 2005.

(Continued)

*Primary Examiner* — Fredrick C Conley
(74) *Attorney, Agent, or Firm* — Mary M. Lee

(57) ABSTRACT

An adjustable body pillow that comprises a center section with first and second legs. One or both of the first and second legs includes an elasticized section that allows the length of the leg to extend or retract. One or both of the legs may include an inwardly extending curve or bulge along its inner perimeter. One or both of the legs may terminate in an inwardly turned toe or may include an inwardly curved foot at the end. In addition to the adjustable length afforded by the elasticized sections, these sections are flatter and amenable to folding or twisting to allow the body pillow to be arranged in multiple configurations.

30 Claims, 18 Drawing Sheets

(56) References Cited

U.S. PATENT DOCUMENTS

| | | | | |
|---|---|---|---|---|
| 5,581,833 | A | 12/1996 | Zenoff | |
| 5,647,076 | A | 7/1997 | Gearhart | |
| 5,729,846 | A | 3/1998 | Sullivan | |
| D413,751 | S | 9/1999 | Alyea | |
| 5,978,990 | A | 11/1999 | Akey | |
| 5,987,674 | A | 11/1999 | Schaffner et al. | |
| D420,845 | S | 2/2000 | Rumage | |
| 6,052,848 | A | 4/2000 | Kelly | |
| 6,081,950 | A | 7/2000 | Selton | |
| 6,088,854 | A | 7/2000 | Brownrigg | |
| D443,461 | S | 6/2001 | Hall et al. | |
| 6,279,185 | B1 | 8/2001 | Matthews | |
| 6,343,727 | B1 | 2/2002 | Leach | |
| 6,354,665 | B1 | 3/2002 | Ross | |
| 6,412,128 | B1 | 7/2002 | Matthews | |
| 6,427,251 | B1 | 8/2002 | Leach | |
| 6,484,337 | B1 | 11/2002 | Moe et al. | |
| 6,499,164 | B1 | 12/2002 | Leach | |
| 6,532,612 | B2 | 3/2003 | Matthews Brown | |
| 6,553,590 | B1 | 4/2003 | Leach | |
| 6,601,252 | B1 | 8/2003 | Leach | |
| 6,658,681 | B2 | 12/2003 | Britto et al. | |
| 6,711,770 | B1 | 3/2004 | Owens et al. | |
| 6,751,817 | B1 * | 6/2004 | Leach | A47C 20/021 5/630 |
| 6,760,934 | B1 | 7/2004 | Leach | |
| 6,795,990 | B1 | 9/2004 | Hutchinson | |
| 6,874,183 | B1 | 4/2005 | Taylor | |
| 7,010,821 | B1 | 3/2006 | Leach | |
| 7,089,614 | B1 | 8/2006 | Clapp | |
| D530,136 | S | 10/2006 | Toth | |
| 7,114,206 | B2 | 10/2006 | Leach | |
| 7,127,760 | B2 | 10/2006 | Bartley et al. | |
| 7,146,663 | B2 | 12/2006 | Brown | |
| 7,331,073 | B2 | 2/2008 | Littlehorn et al. | |
| 7,353,552 | B2 | 4/2008 | Leach | |
| 7,500,278 | B2 | 3/2009 | Leach | |
| 7,513,001 | B1 | 4/2009 | Leach | |
| 7,562,406 | B1 | 7/2009 | Leach | |
| 7,657,954 | B1 | 2/2010 | Bunkers | |
| 7,676,871 | B1 | 3/2010 | Leach | |
| 7,708,342 | B2 | 5/2010 | Leach | |
| 7,788,752 | B2 | 9/2010 | Tidwell | |
| 7,793,371 | B1 | 9/2010 | Leach | |
| 7,818,842 | B2 | 10/2010 | Marciano | |
| 7,878,587 | B1 | 2/2011 | Leach | |
| 7,886,381 | B2 | 2/2011 | Aiken et al. | |
| 7,926,135 | B1 | 4/2011 | Leach | |
| 7,958,582 | B1 | 6/2011 | Scamardo | |
| 8,074,310 | B1 | 12/2011 | Robbins | |
| 8,136,186 | B1 | 3/2012 | Leach | |
| 8,146,760 | B1 | 4/2012 | Leach | |
| 8,418,295 | B2 | 4/2013 | Clark | |
| 8,419,128 | B1 | 4/2013 | Leach | |
| 8,448,275 | B1 | 5/2013 | Leach | |
| 8,458,830 | B1 | 6/2013 | Pierce et al. | |
| 8,468,627 | B2 | 6/2013 | Leach | |
| 8,479,334 | B1 | 7/2013 | Leach | |
| 8,555,429 | B2 | 10/2013 | Leach | |
| 8,661,587 | B1 | 3/2014 | Leach | |
| 8,661,588 | B1 | 3/2014 | Leach | |
| 8,671,480 | B1 | 3/2014 | Leach | |
| 8,914,927 | B1 | 12/2014 | Leach | |
| 9,003,565 | B1 | 4/2015 | Leach | |
| 9,021,635 | B1 | 5/2015 | Leach | |
| 9,032,572 | B1 | 5/2015 | Leach | |
| 9,101,169 | B1 | 8/2015 | Leach | |
| 9,113,718 | B1 | 8/2015 | Leach | |
| 9,635,956 | B1 | 5/2017 | Leach | |
| 9,693,638 | B1 | 7/2017 | Leach | |
| 2004/0060116 | A1 | 4/2004 | Matthews Brown | |
| 2005/0278864 | A1 | 12/2005 | Leach | |
| 2006/0031992 | A1 | 2/2006 | Moore | |
| 2006/0288485 | A1 | 12/2006 | Fox | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0180623 | A1 | 8/2007 | Stein et al. | |
| 2007/0226910 | A1 * | 10/2007 | Tidwell | A47D 13/08 5/655 |
| 2007/0277321 | A1 | 12/2007 | Leach | |
| 2008/0028529 | A1 | 2/2008 | Abell | |
| 2010/0077551 | A1 | 4/2010 | Liu | |
| 2012/0073055 | A1 | 3/2012 | Cupo | |
| 2014/0000034 | A1 | 1/2014 | Alexander | |
| 2014/0196214 | A1 | 7/2014 | DuPre | |

OTHER PUBLICATIONS

The Leachco Lil' Snoogle product, which is shown and described in the webpage attached as Exhibit 2, was in public use and/or on sale at least as early as about Dec. 1999.

The Leachco All Nighter product, which is shown and described in the webpage attached as Exhibit 3, was in public use and/or on sale at least as early as about May 2002.

The Leachco Prop Ease product, which is shown and described in the packaging material attached as Exhibit 4, was in public use and/or on sale at least as early as about 2005.

The Leachco Snoogle product, which is shown and described in the webpage attached as Exhibit 5, was in public use and/or on sale at least as early as about May 1999.

The Leachco Mini Snoogle product, which is shown and described in the webpage attached as Exhibit 6, was in public use and/or on sale at least as early as about Dec. 1999.

The Leachco Snoogle Loop product, which is shown and described in the webpage attached as Exhibit 7, was in public use and/or on sale at least as early as about Dec. 1999.

The Leachco Snoozoo product, which is shown and described in the webpage attached as Exhibit 8, was in public use and/or on sale at least as early as about May 2005.

The Leachco Snoogle Half-Time product, which is shown and described in the webpage attached as Exhibit 9, was in public use and/or on sale at least as early as about Jul. 2005.

The Leachco Back 'N Belly product, which is shown and described in the webpage attached as Exhibit 10, was in public use and/or on sale at least as early as about Jun. 2003.

The Leachco Grow to Sleep pillow. which is shown and described in the webpage attached as Exhibit 11, was in public use and/or on sale at least as early as about Aug. 8, 2005.

The Leachco Preggle product, which is shown and described in the webpage attached as Exhibit 12, was in public use and/or on sale at least as early as about Dec. 2006.

The Leachco Boomerest pillow, which is shown and described in the webpage attached as Exhibit 13, was in public use and/or on sale at least as early as about May 23, 2005.

The Leachco Nogster pillow, which is shown and described in the webpage attached as Exhibit 14, was in public use and/or on sale at least as early as about Jul. 17, 2006.

* cited by examiner

ADJUSTABLE BODY PILLOW

FIELD OF THE INVENTION

The present invention relates generally to pillows and, more particularly but without limitation, to body pillows.

DETAILED DESCRIPTION OF AN EMBODIMENT OF THE INVENTION

Body pillows enjoy increasing popularity among consumers. While one major use is to provide back and abdominal support for expectant mothers, many others use body pillows for supporting the body while sleeping or reclining. The present invention provides a body pillow with legs and an elasticized section in one or both of the legs. In addition to the adjustable length afforded by the elasticized sections, these sections are flatter and thus more amenable to folding or twisting than the rest of the body pillow.

Figure 1:
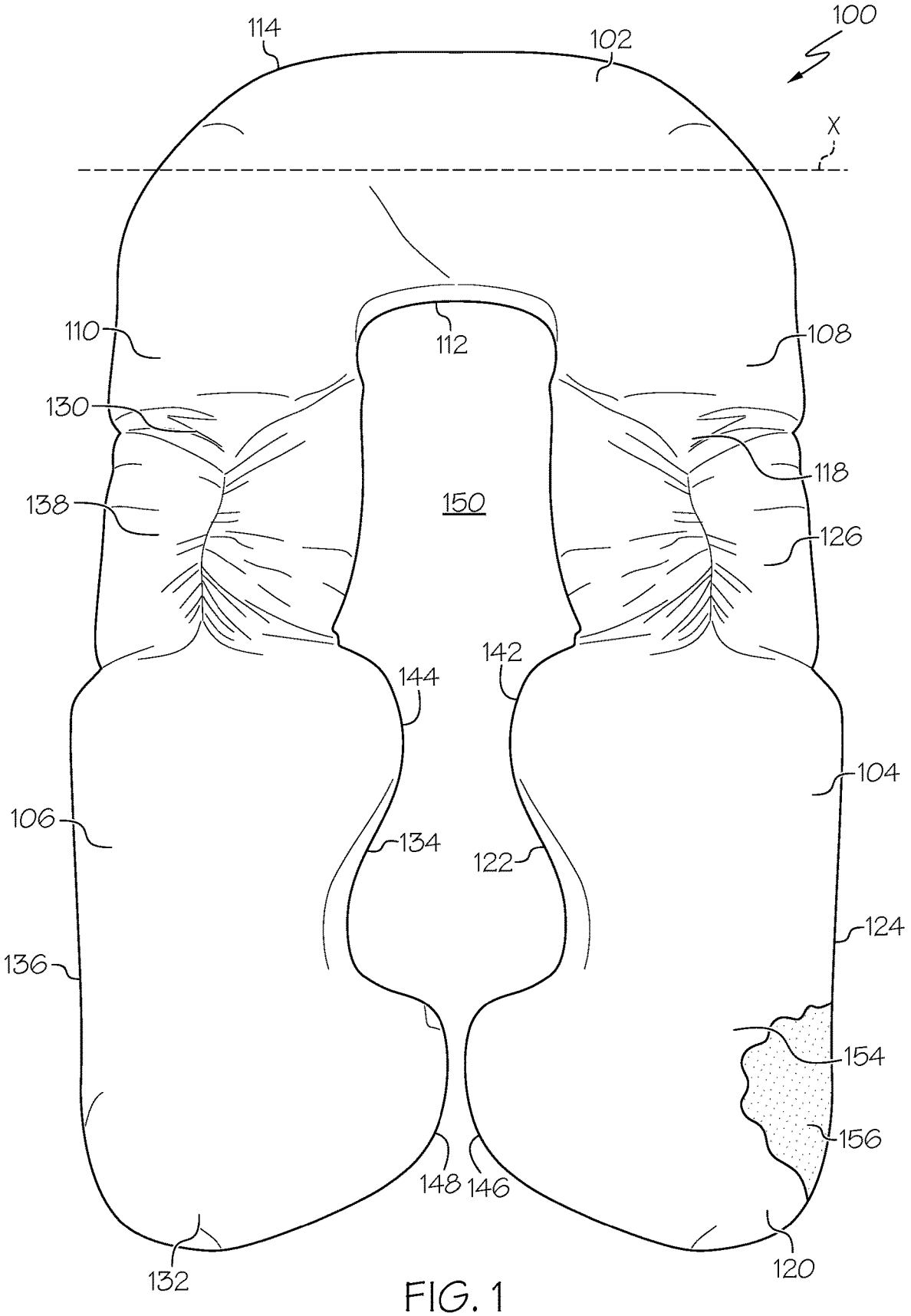
FIG. 1 is a plan view of an adjustable body pillow made in accordance with an embodiment of the present invention. The pillow is shown in its resting position.

Turning now to the drawings in general and to FIG. 1 in particular, there is shown therein an adjustable body pillow made in accordance with a first embodiment of the present invention and designated generally by the reference number 100. The body pillow 100 generally comprises a center section 102, a first leg 104, and a second leg 106.

The center section 102 in this embodiment has a first end 108, a second end 110, an inner perimeter 112, and an outer perimeter 114. The inner perimeter 112 may define a semi-circle, as shown. The outer perimeter 114 of the center section 102 may also form a semi-circle. In one embodiment, as shown, the semi-circle formed by the inner perimeter 112 of the center section 102 and the semi-circle formed by the outer perimeter 114 of the center section are concentric. As used herein, "semi-circle" denotes a generally curved shape and does not require a precise radius of curvature or an arc of precisely 180 degrees. Alternately, the outer perimeter may be angular (polygonal), or may form square corners. Still further, the center section 102 may be square or rectangular so that the inner and outer perimeters 112 and 114 are straight.

The first leg 104 has a first end 118, a second end 120, an inner perimeter 122, and an outer perimeter 124. The first leg 104 also may have an elasticized section 126 between the first and the second ends 118 and 120. The first end 118 is connected to the first end 108 of the center section 102. In this embodiment, the elasticized section 126 is at the first end 118 of the first leg 104, but the size and location of the elasticized section may vary.

The second leg 106 has a first end 130, a second end 132, an inner perimeter 134, and an outer perimeter 136. The first end 130 is connected to the second end 110 of the center section 102. In this embodiment, the second leg 106 also includes an elasticized section 138 between the first and the second ends 130 and 132 of the second leg 106. In this embodiment, the elasticized section 138 is at the first end 130 of the second leg 106, but the size and location of the elasticized section may vary.

The contours and dimensions of the legs 104 and 106 may vary. Moreover, the contour and dimensions of the first leg 104 may be the same or may be different from the contour and dimensions of the second leg 106. In the embodiment shown in FIG. 1, the first and second legs 104 and 106 are similarly formed having the same overall length, and the contours of the inner perimeters 122 and 134 are mirror images of each other.

In the exemplary embodiment of FIG. 1, there is an inwardly extending bulge 142 and 144 on the inner perimeters 122 and 134 of each of the first and second legs 104 and 106, respectively. The size and location of the bulges 142 and 144 may vary. In one embodiment as shown, the bulges 142 and 144 are immediately below the elasticized sections 126 and 138. Additionally, in the exemplary embodiment of FIG. 1, each of the first and second legs 104 and 106 includes an inwardly turned toe 146 and 148 on the second ends 120 and 132, respectively. In the example shown, the elasticized sections 126 and 138 extend between the bulges 142 and 144 and the adjacent ends 108 and 110 of the center section 102. Alternately, the elasticized sections could be about midway between the first and second ends of the legs and the bulge may or may not be omitted. Still further, the elasticized sections may be between the bulge and the toe end of the legs.

As depicted in FIG. 1, the first and second legs 104 and 106 both extend at an angle relative to the longitudinal axis X of the center section 102 in the same plane. The legs 104 and 106 may be generally parallel as shown or may diverge slightly from the center section 102. In this way, when the body pillow 100 is in the resting state, the inner perimeters of the center section 102 and the first and second legs 104 and 106 are continuous and together form a body receiving space 150. As used herein, "resting position" and "resting state" refer to the position and shape that the pillow naturally assumes when no tension or pressure is exerted on any part of it.

The construction of the pillow 100 may vary. The pillow 100 may include a fabric enclosure 154 filled with a compressible material 156. The fabric enclosure 154 may be any suitable fabric, including but not limited to a polyester/cotton blend, waterproof nylon, cotton, flannel, or elastic fabrics, such as spandex or cotton-spandex blends. One suitable filler material is polyester fiberfill. Other suitable fillers include down feathers, memory foam, and polystyrene pellets. Still further, the compressible material could be an inflatable insert.

The body pillow 100 may be sized so that its length is generally about equal to the height of the intended user. In one embodiment, the length of the pillow 100 is such that when a user is lying in the body receiving space 150 with her head resting on the center section 102, the ends 120 and 132 of the legs 104 and 106 will be long enough to support the user's lower legs and feet. Now it will be apparent that the body pillow 100 may be provided in different sizes for children, men, and women.

Figure 2:
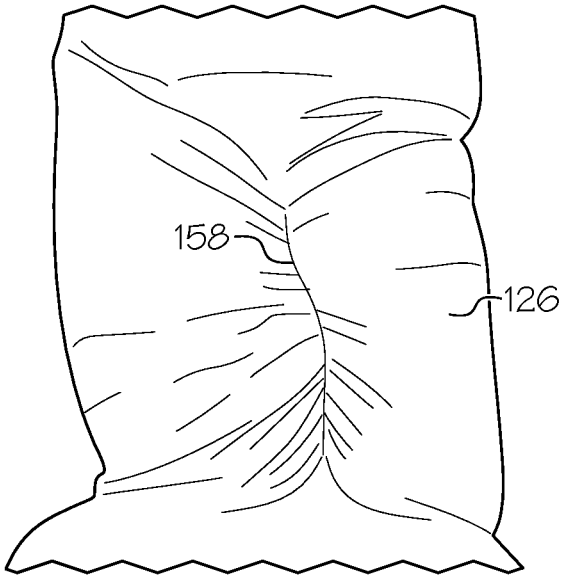
FIG. 2 is an enlarged, fragmented view of the elasticized section of one of the legs of the body pillow in FIG. 1 in the resting of non-expanded position.
Figure 3:
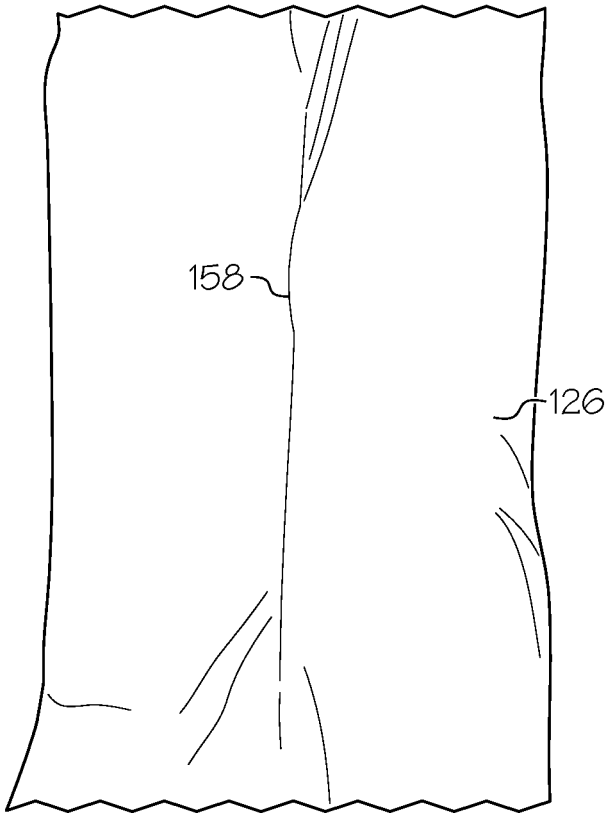
FIG. 3 is an enlarged, fragmented view of the elasticized section shown in FIG. 1 in the expanded position.

FIGS. 2 and 3 illustrate the elasticized section 126. As the elasticized section 126 and 138 are similarly formed, only the section 126 will be discussed in detail. As illustrated in FIGS. 2 and 3, the elasticized section 126 can be stretched or extended. Although the extent to which the section 126 expands may vary, in one embodiment the section 126 may stretch or extend to about twice its resting or non-expanded length.

The manner of constructing the elasticized sections 126 and 138 may vary. The elasticized sections 126 and 138 may be formed by stitching or otherwise affixing one or more strips of elastic along the length of the fabric sections forming the elasticized sections. In one embodiment, the elasticized sections 126 and 138 may start out as continuous with the center section 102 and legs 104 and 106. That is, the elasticized sections 126 and 138 may start out as a continuous part of the fabric enclosure 154 filled with the compressible material 156. Then, an elastic strip or band is stitched lengthwise along the center of the top of each leg to form the elasticized sections 126 and 138. The elastic is stitched with the fabric and the elastic strip in the fully expanded length (FIG. 3) so that, when released, the sections 126 and 138 becomes gathered (FIG. 2) along the line 158 where the elastic is stitched.

The length of the unstretched elasticized sections 126 and 138 may vary, although an ideal length is between about 8 and about 16 inches. More preferably, the length may be between about 10 and 14 inches, and most preferably is between about 11 and 12 inches in length. The extended length of the elasticized sections 126 and 138 may be between about 14 and 22 inches and preferably is about 18 inches. The elasticized sections 126 and 138 may be in the same position on both legs or in a different position on each leg. The elasticized sections 126 and 138 may be the same length or different lengths.

Figure 4:
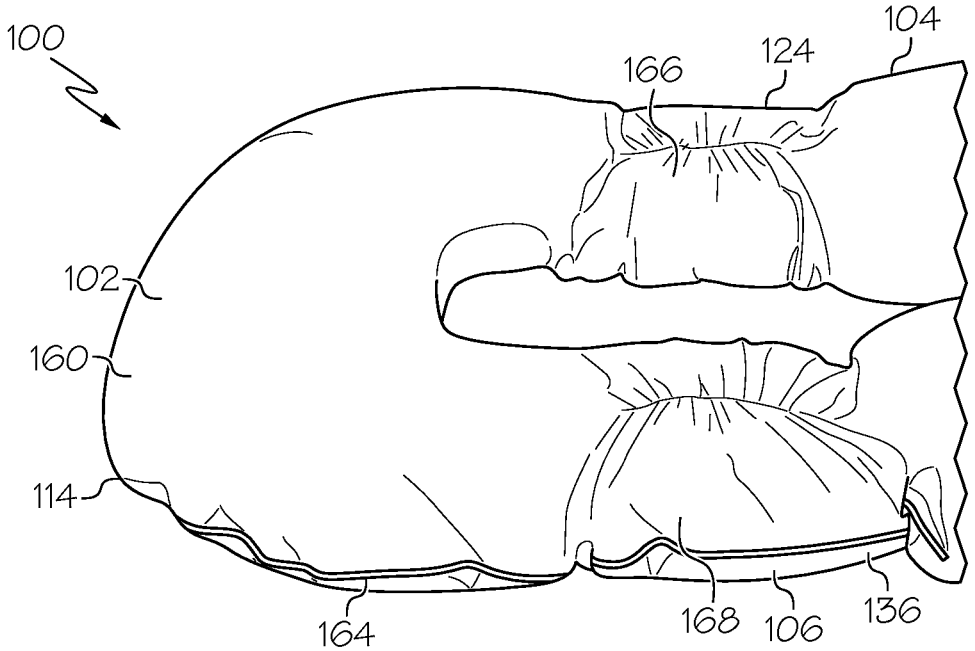
FIG. 4 is a right side fragmented, perspective view of the upper part of the body pillow showing the body pillow with the shape-conforming cover and the position of a long zipper following the outer perimeter.
Figure 5:
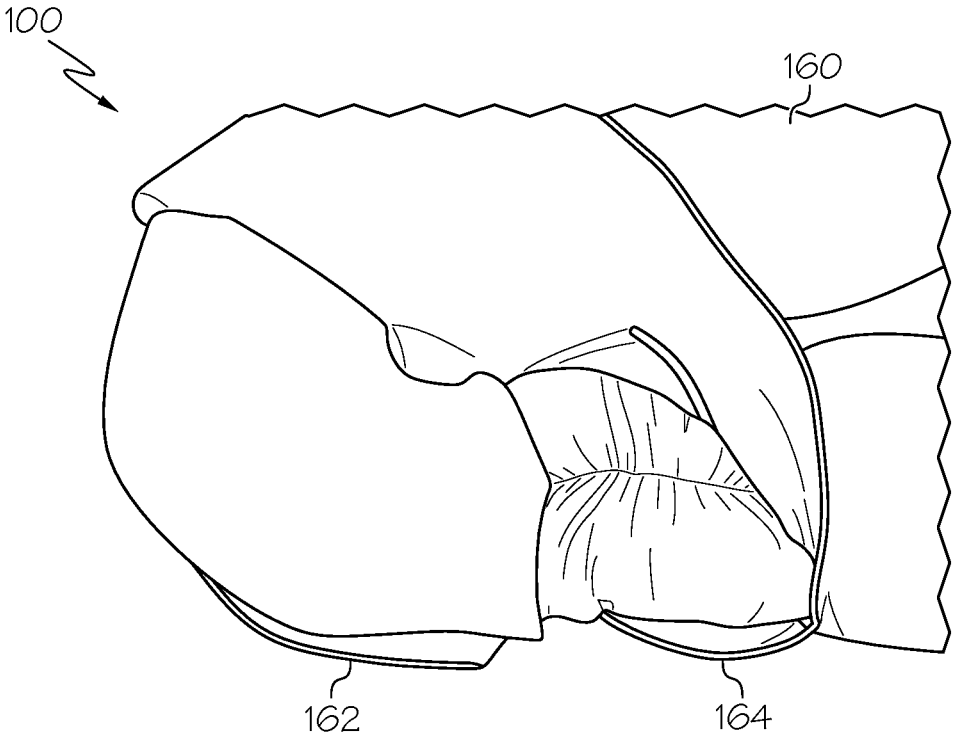
FIG. 5 is a right side fragmented, perspective view of the upper part of the body pillow showing the body pillow and cover with the zippered closure open and the top portion of the cover pulled back exposing the pillow inside.

As shown in FIGS. 4 and 5, the body pillow 100 may comprise a removable cover 160 shaped to conform to the shape of the body pillow when the body pillow is in the resting position. The removable cover 160 may include an opening 162 for inserting and removing the pillow 100. As shown in FIGS. 4 and 5, the opening 162 may extend around the outer perimeter 114 of the center section 102 and may extend down along the outer perimeters 124 and 136 of the legs 104 and 106. In the embodiment shown, this opening 162 is about 120 inches, as this allows ample room to manipulate the pillow 100 into and out of the cover 160 as needed. Of course, the position and length of the opening 162 may vary. Similarly, although the closure shown is a zipper 164, other closures may be used instead, such as snaps, hooks, ties, buttons, and hook-and-loop fasteners.

As shown in FIGS. 4 and 5, the pillow cover 160 includes elasticized sections 166 and 168 that correspond to the elasticized sections 126 and 138 (FIG. 1) in the pillow 100. In the embodiment shown, a strip of elastic is stitched to the inside surface of the fabric forming the top and bottom of the cover 160. The cover 160 will be formed with corresponding contours to match the contours of the pillow 100, such as the bulges 142 and 144 and the toes 146 and 148 (FIG. 1). In this way, the pillow 100 will fit snugly inside the cover 160.

Figure 6:
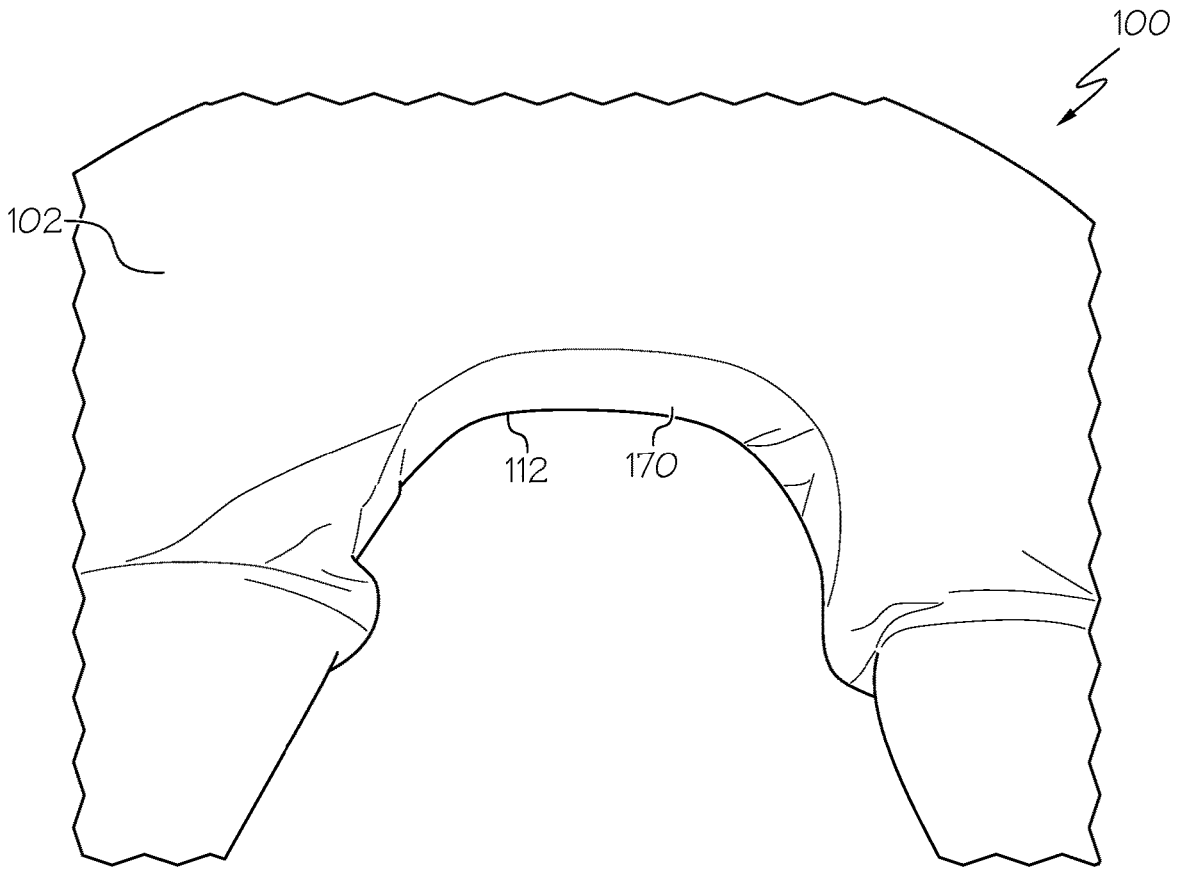
FIG. 6 is an enlarged, fragmented, frontal perspective view of the inner perimeter of the center section of the pillow showing the tension relief gusset in the relaxed position.
Figure 7:
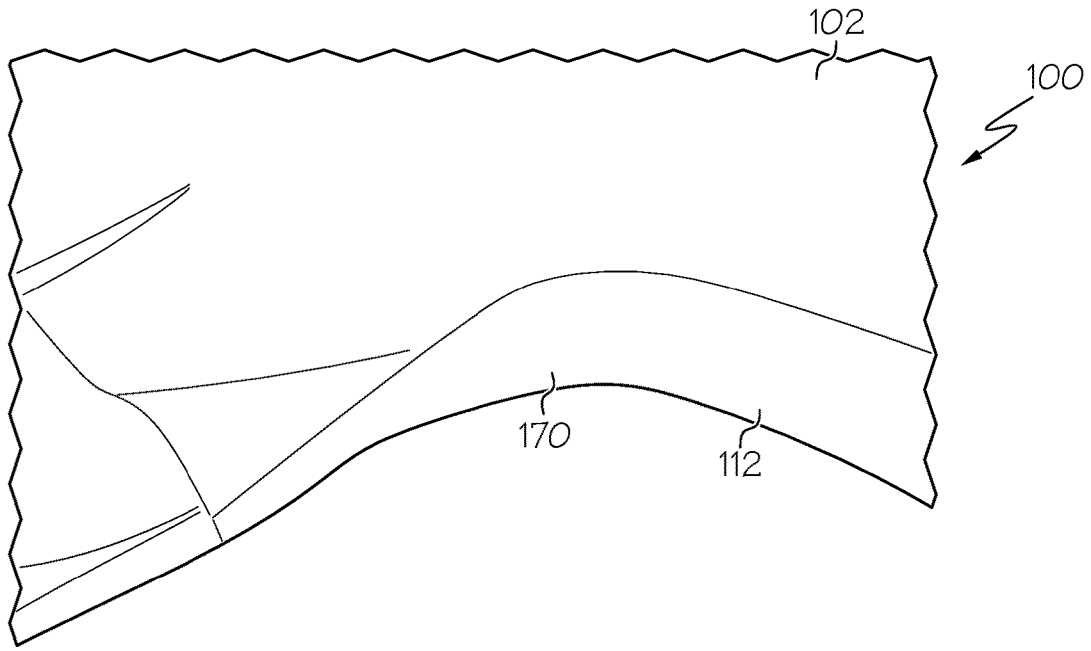
FIG. 7 is an enlarged, fragmented, frontal perspective view of the inner perimeter of the center section of the pillow showing the tension relief gusset expanded.
Figure 9:
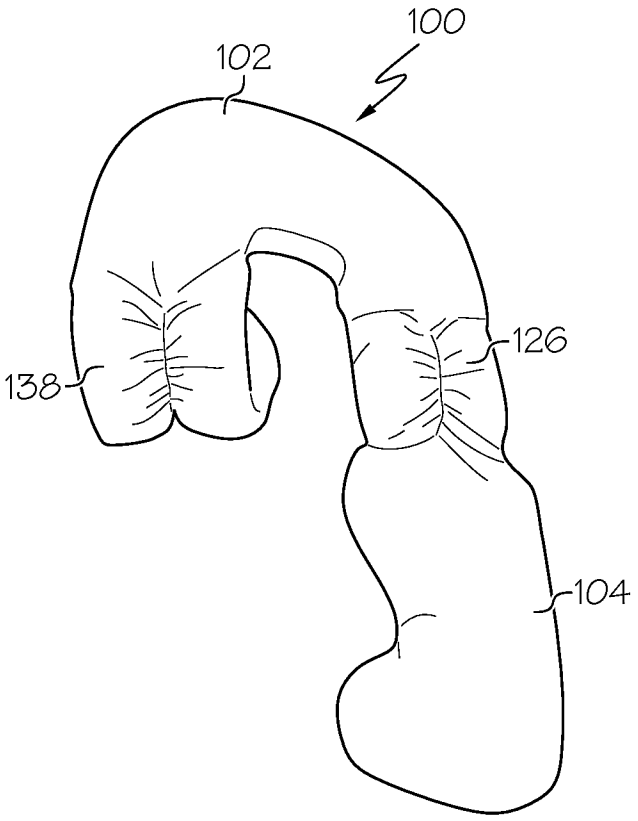
FIG. 9 shows the body pillow of FIG. 1 with the second leg folded under the center section at the elasticized section.
Figure 8:
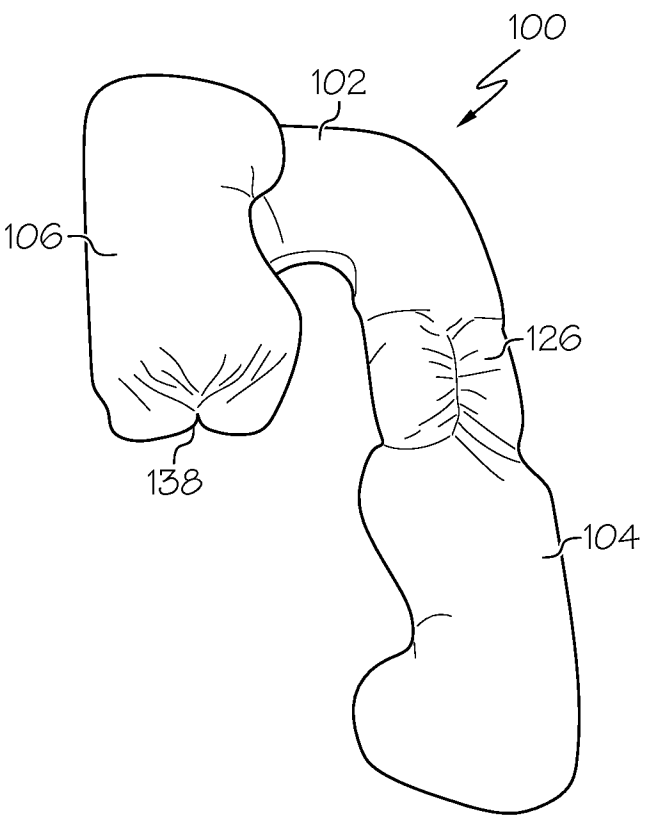
FIG. 8 shows the body pillow of FIG. 1 with the second leg folded up over the center section at the elasticized section.
Figure 11:
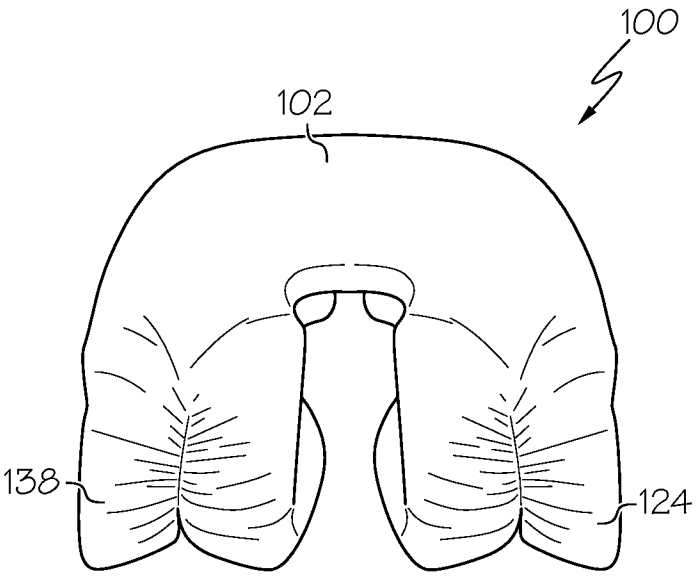
FIG. 11 shows the body pillow of FIG. 1 with both legs folded under the center section at the elasticized section.
Figure 10:
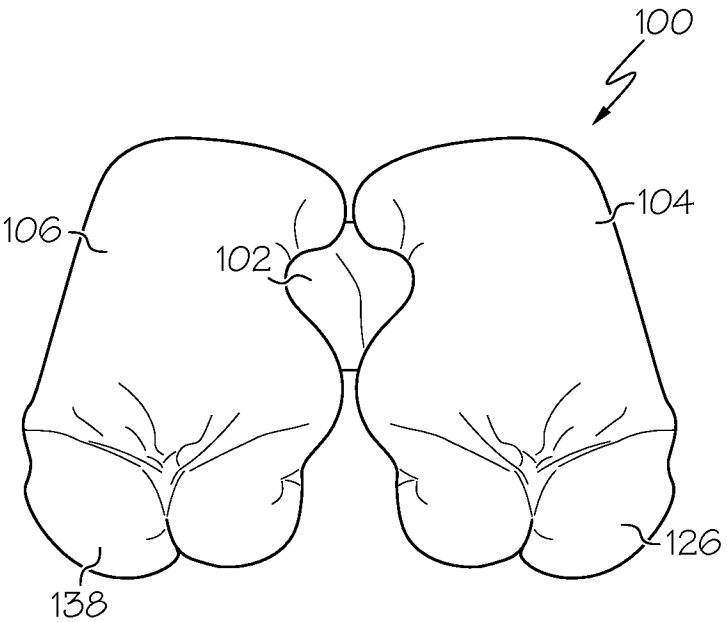
FIG. 10 shows the body pillow of FIG. 1 with both legs folded up over the center section at the elasticized section.

Turning now to FIGS. 6 and 7, another advantageous feature of the present invention will be explained. The inner perimeter 112 of the center section 102 may be provided with a tension relief gusset 170. The shape and dimensions of the gusset 170 may vary. In the embodiment shown, the gusset extends the length the inner perimeter 112. The gusset 170 may be one to several inches wide at its center and taper to a point at each end as seen in FIG. 7. The gusset 170 makes it easier to manipulate the legs 104 and 106 as there is no center seam offering resistance.

Figure 13:
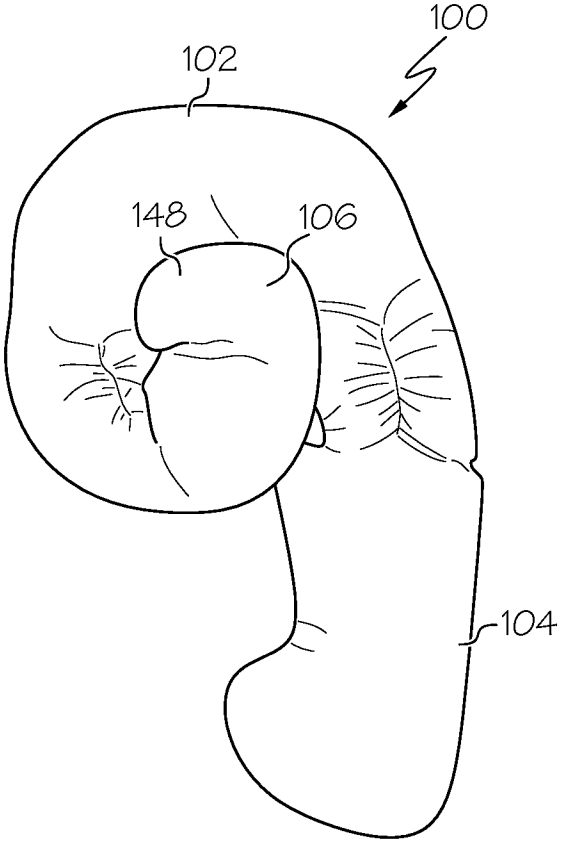
FIG. 13 shows the body pillow of FIG. 1 with the second leg curled inwardly so that the toe is received in the inner perimeter of the center section.
Figure 12:
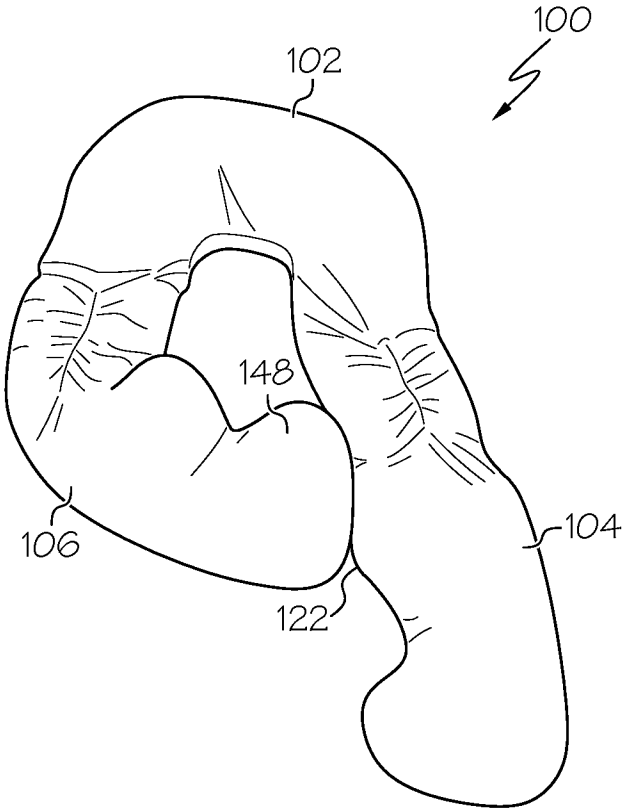
FIG. 12 shows the body pillow of FIG. 1 with the second leg curled inwardly so that the toe is received in the inner perimeter of the first leg.

FIGS. 8-13 illustrate various configurations for the body pillow 100 that are facilitated by the elasticized sections 126 and 138. Either or both of the legs 104 and 106 may be folded up over or under the center section at the elasticized sections 126 and 138, as seen in FIGS. 8-11. Alternately, one of the legs 106 may be curled inwardly so that the toe 148 is received in the inner perimeter 122 of the other leg 104, as seen in FIG. 12, or curled more tightly so that the toe 148 of one leg 106 is received in the inner perimeter 112 of the center section 102, as depicted in FIG. 13. Of course, this arrangement may be reversed.

Figure 14:
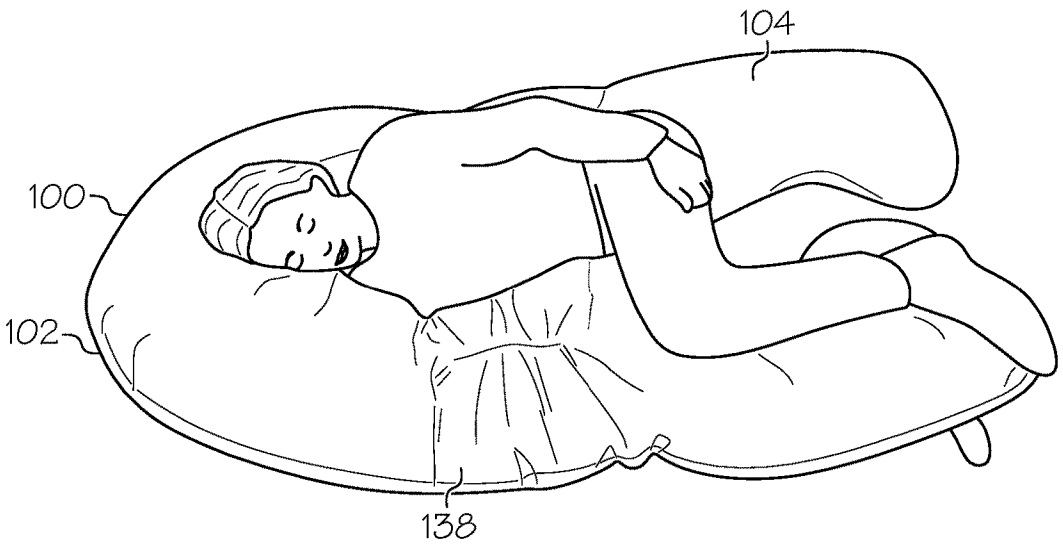
FIG. 14 shows a user in a side-lying position with her head resting on the center section, the first leg supporting her back, and the right leg supporting her upper leg bent at the knee.
Figure 15:
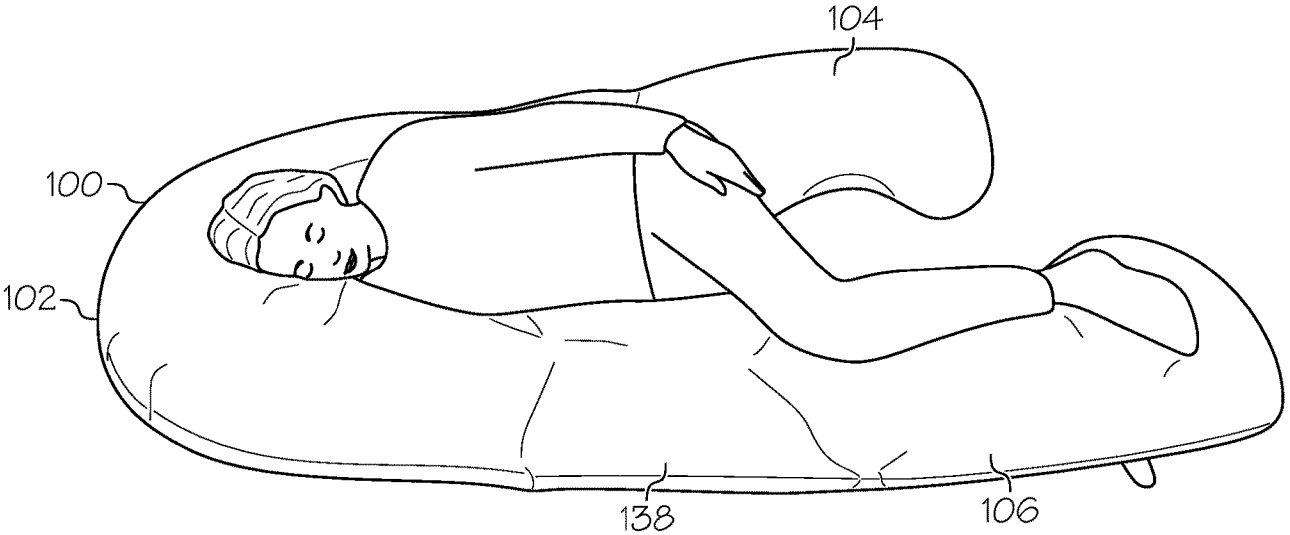
FIG. 15 shows a user in a side-lying position with her head resting on the center section, the first leg of the pillow supporting her back, and the right leg of the pillow supporting her upper leg and knee. The upper leg is extended slightly, and the elasticized section of the pillow leg underneath is extended to offer support to the full length of the leg and foot.

FIG. 14 shows a user in a side-lying position with her head resting on the center section 102 of the body pillow 100. The first leg 104 supporting her back and the second leg 106 supporting her upper leg bent at the knee. The elasticized section 138 is in the resting or non-expanded position. In FIG. 15, the user is in a similar side-lying position with her head resting on the center section 102 and the first leg 104 supporting her back. Here, the user's right (upper) leg is extended slightly and the elasticized section 138 of the pillow leg 106 underneath is extended to offer support to the full length of the leg and foot.

FIGS. 14 and 15 illustrate one method of using the adjustable pillow 100. The user positions the pillow 100 in the desired location and configuration. Then, as desired, the user adjusts the length of the one leg 106 by stretching the elasticized section 138. As needed, such as when turning from side to side, the user may alternately or simultaneously adjust the length of the other leg 104 by stretching the elasticized section 126.

As shown in these drawings, one advantage of the elasticized sections 126 and 138 is that they do not both have to be extended at the same time. For example, this allows the bulge 144 and toe 148 in the second leg 106 to be positioned independently of the bulge 142 and toe 146 in the first leg 104. Now it will also be appreciated how the gathered, elasticized sections 126 and 138 in the legs 104 and 106 form highly bendable, foldable hinges or joints in the legs 104 and 106.

Figure 16:
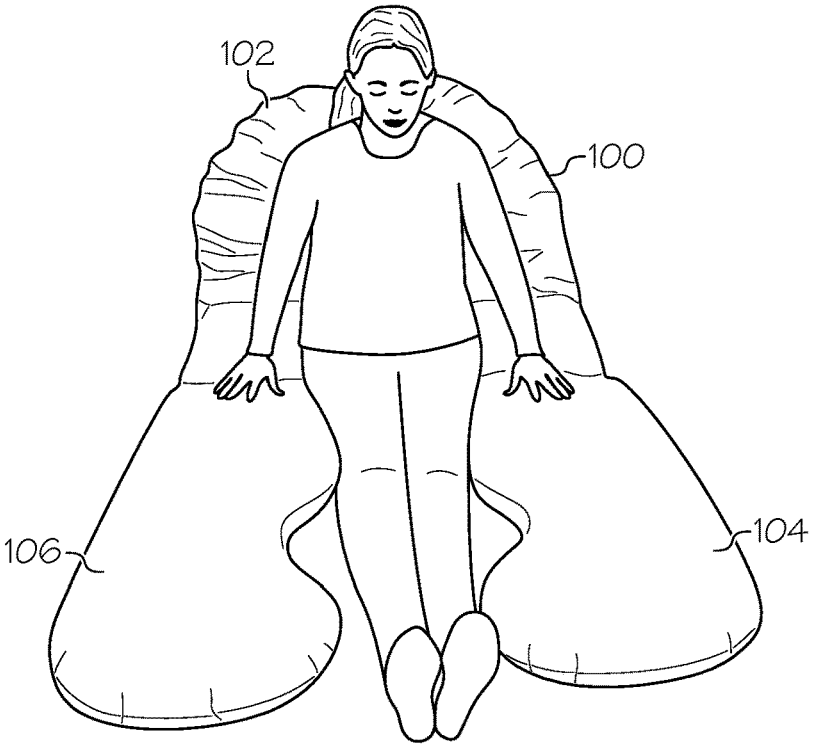
FIG. 16 shows a user in a partially reclining position with her back supported on the center section of the pillow and the legs underneath her forearms.
Figure 17:
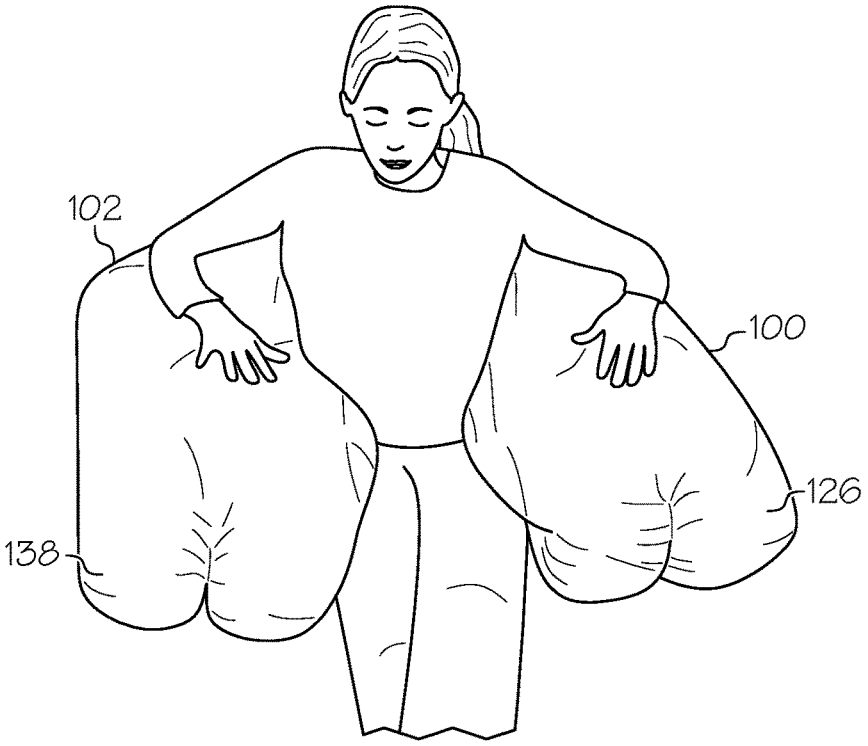
FIG. 17 shows a user in a sitting position using the body pillow as a study pillow with the legs folded under at the elasticized section for elevated support of the user's arms.
Figure 18:
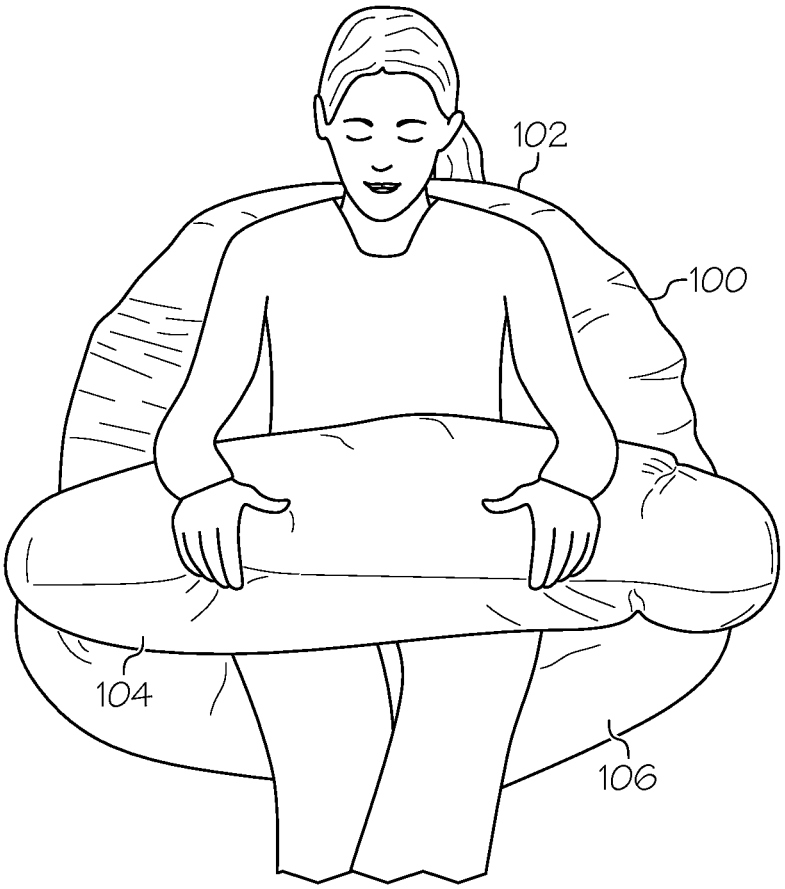
FIG. 18 shows a user in a sitting position using the body pillow as a study pillow with the pillow leg under her legs and the other pillow leg across her lap.

FIGS. 16-18 show examples of how the inventive pillow 100 can be configured for use as a study pillow or to provide a seat cushion or lap cushion or both. FIG. 16 shows a user in a partially reclining position with her back supported on the center section 102 of the pillow 100 and the legs 104 and 106 underneath her forearms. FIG. 17 shows a user in a sitting position using the body pillow 100 as a study pillow with the legs folded under at the elasticized sections 126 and 138 for elevated support of the user's arms. FIG. 18 shows a user in a sitting position using the body pillow 100 as a study pillow with the pillow leg 106 under her legs and the other pillow leg 104 across her lap.

Figure 19:
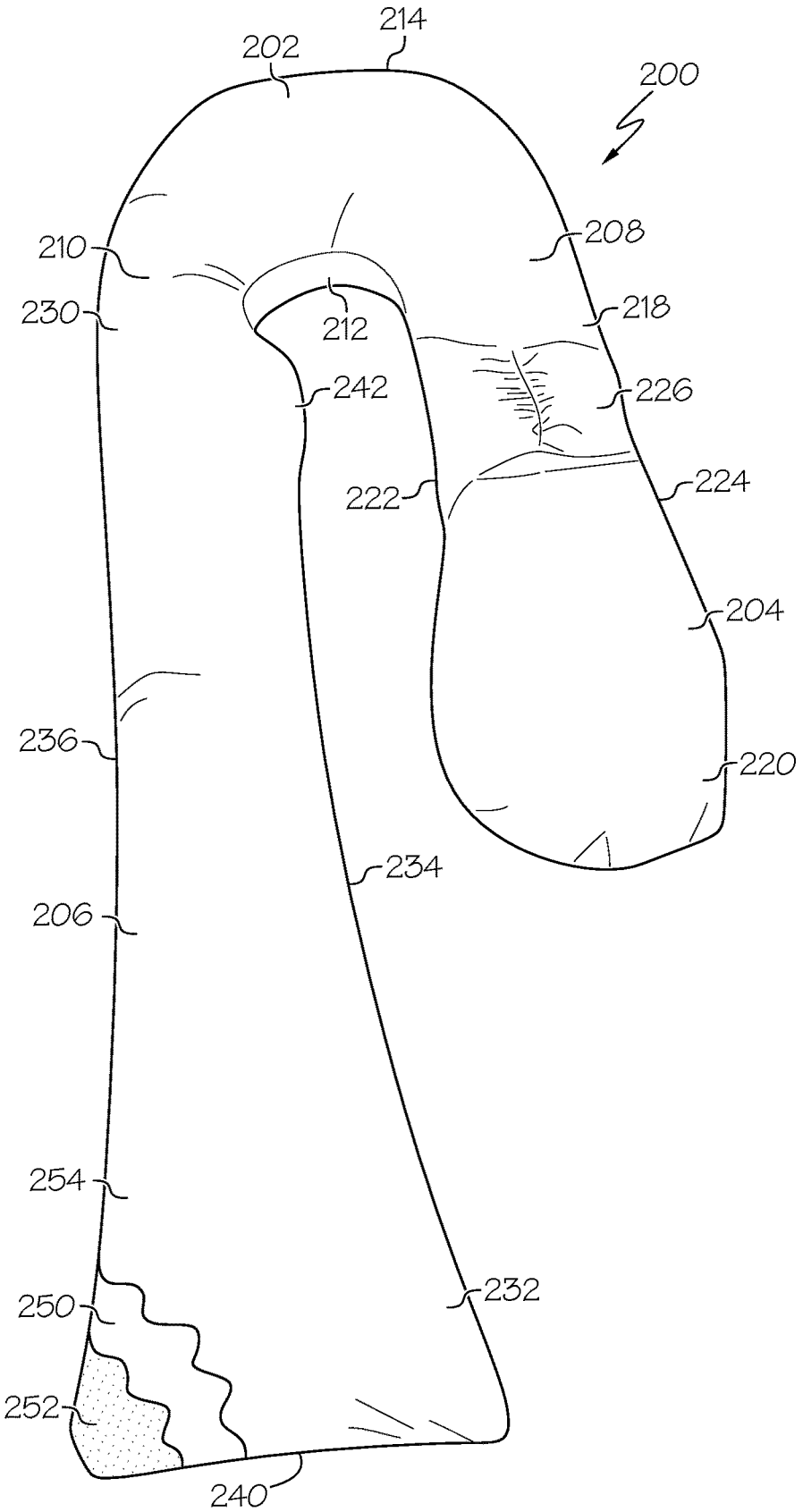
FIG. 19 is frontal perspective view of an adjustable body pillow made in accordance with another embodiment of the present invention. The pillow is shown in its resting position. The body pillow has one short leg with a bulbous end and an elasticized section and one long leg with a bell-shaped end and no elasticized section.

With reference now to FIG. 19, another embodiment of the adjustable body pillow of the present invention will be described. In this embodiment, shown in its resting position in FIG. 19, the body pillow 200 generally comprises a center section 202, a first leg 204, and a second leg 206. The center section 202 in this embodiment has a first end 208, a second end 210, an inner perimeter 212, and an outer perimeter 214. The inner perimeter 212 may define a semi-circle, as shown. The outer perimeter 214 of the center section 202 may also form a semi-circle. In the embodiment shown, the semi-circle formed by the inner perimeter 212 of the center section 202 and the semi-circle formed by the outer perimeter 214 of the center section are concentric. However, as in the previously described embodiment, the shape of the outer perimeter 214 may vary.

The first leg 204 has a first end 218, a second end 220, an inner perimeter 222, and an outer perimeter 224. The first leg 204 also may have an elasticized section 226 between the first and the second ends 218 and 220. The first end 218 is connected to the first end 208 of the center section 202. In this embodiment, the elasticized section 226 is at the first end 218 of the first leg 204, but the size and location of the elasticized section may vary. In this embodiment, the second or free end 220 is bulbous, that is, the end is generally rounded in all dimensions.

The second leg 206 has a first end 230, a second end 232, an inner perimeter 234, and an outer perimeter 236. The first end 230 is connected to the second end 210 of the center section 202. In this embodiment, the second leg 206 does not include an elasticized section. As shown in FIG. 19, the second leg 206 may be longer than the first leg 204, and may be about twice as long as the first leg. The second or free end 232 of the second leg 206 may be bell-shaped in profile when viewed from above. That is, the end 232 may flare slightly at the sides becoming wider than the rest of the leg 206. Additionally, the end 232 may taper along the bottom edge to a flattened or beveled edge 240 when viewed from the side (not shown). The contours of the inner and outer perimeters 234 and 236 of the second leg 206 may vary. In this embodiment, the inner perimeter 234 at the first end 230 adjacent the inner perimeter 212 of the center section 202 may define an inwardly extending bulge 242.

Figure 20:
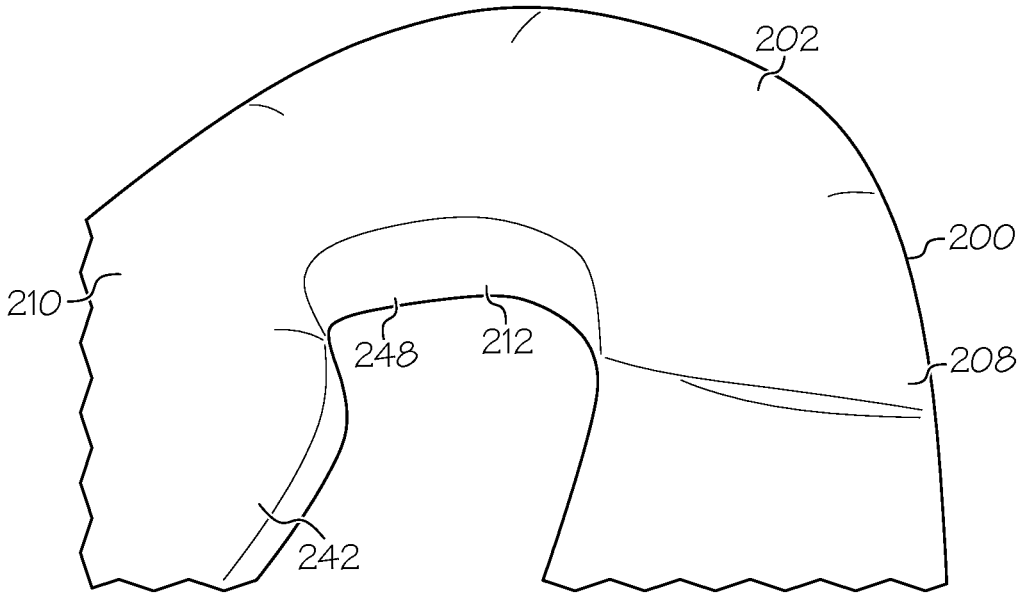
FIG. 20 is an enlarged, fragmented, frontal perspective view of the inner perimeter of the center section of the pillow of FIG. 19 showing the tension relief gusset.
Figure 21:
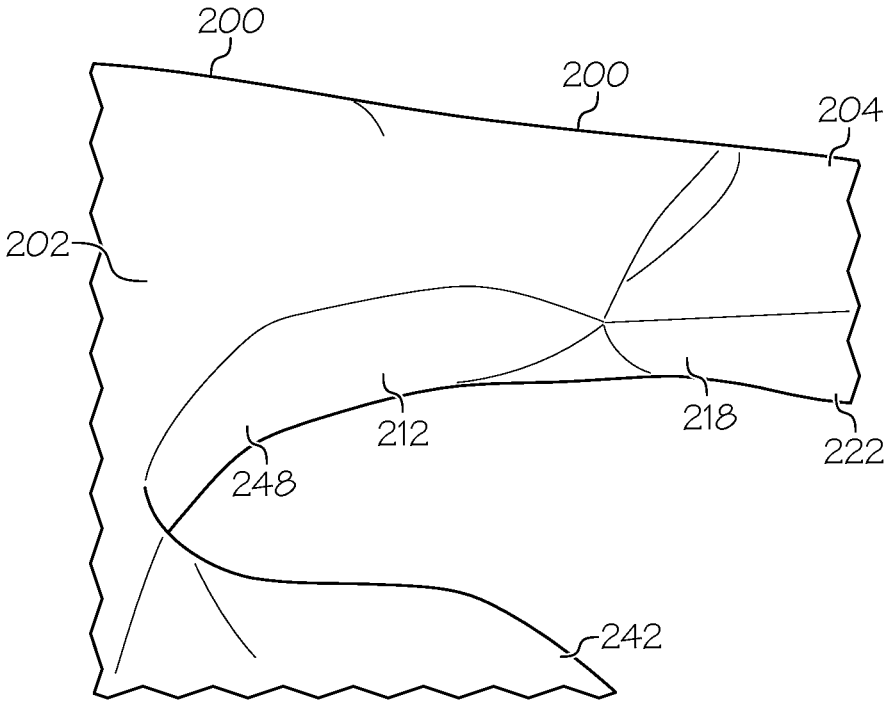
FIG. 21 is an enlarged, fragmented, right perspective view of the inner perimeter of the center section of the pillow of FIG. 19 showing the end of the tension relief gusset at the first end of the center section.
Figure 22:
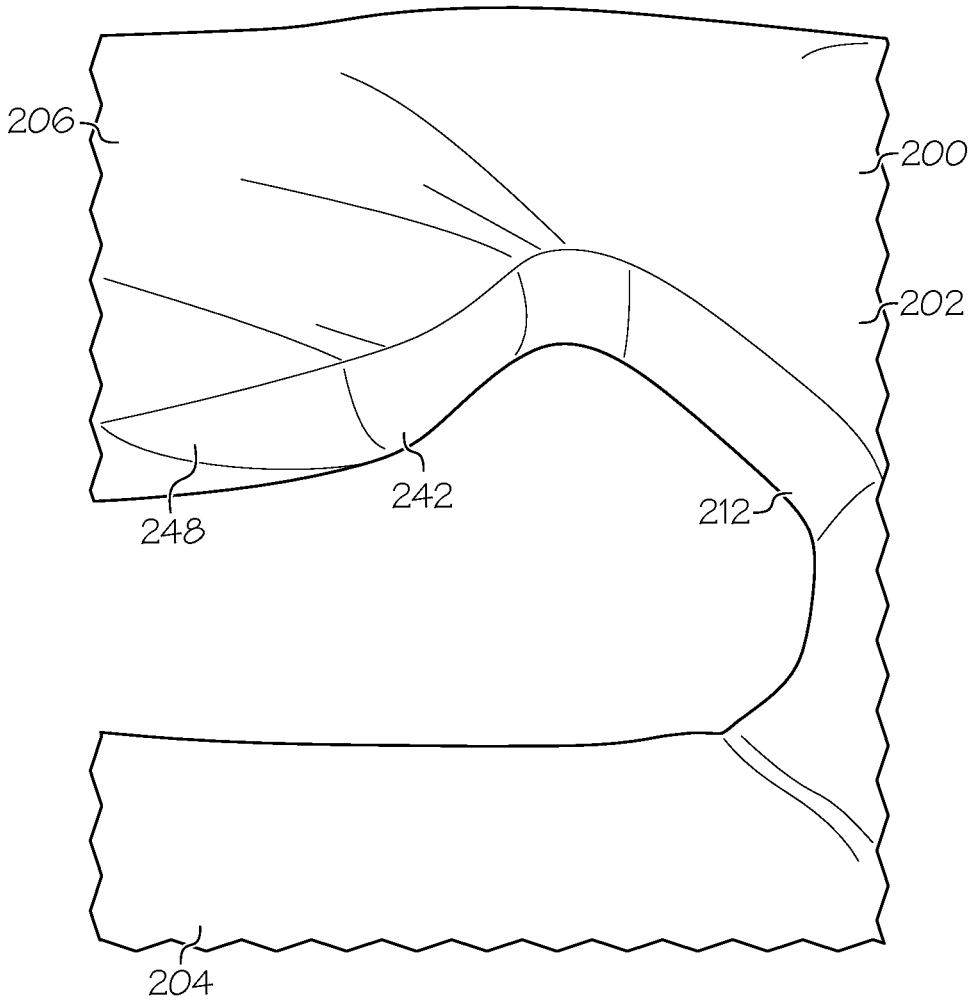
FIG. 22 is an enlarged, fragmented, left perspective view of the inner perimeter of the center section of the pillow of FIG. 19 showing the end of the tension relief gusset at the second end of the center section.

As seen in FIGS. 20-22, the body pillow 200 may include a tension relief gusset 248 with a similar construction and for a similar purpose as the gusset 170 (FIGS. 6&7) described above for the body pillow 100. The gusset 248 extends across the inner perimeter 212 of the center section 202 and down to the first end 218 of the first leg 204, as shown in FIG. 21. The gusset 248 may extend down in the inside of the bulge 242 on the second leg 206. As in the previous embodiment, the shape and dimensions of the gusset 248 may vary. In the embodiment shown, the gusset 248 tapers to a point at each end.

As in the previous embodiment, the pillow 200 may comprise a fabric enclosure 250 that contains a suitable filler as a compressible material 252. Similarly, the pillow 200 may include a shape-conforming removable cover 254 with an elasticized section corresponding to the elasticized section in the first leg 204. The body pillow 200 and cover 254 may include an access opening with a zippered closure (not shown) similar to the previous embodiment. While the length and position of the zippered closure may vary, one suitable position is along the outer perimeters 214, 224, and 236 of the center section 202, the first leg 204, and the second leg 206, respectively.

Figure 24:
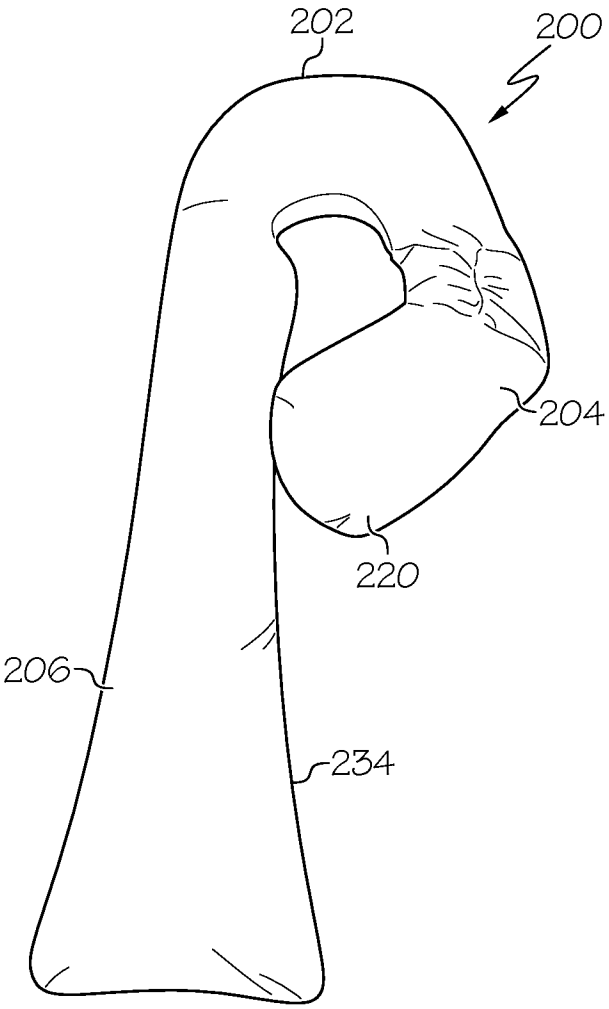
FIG. 24 shows the body pillow of FIG. 19 with the short leg turned inward so that the bulbous end is received in the inner perimeter of the second longer leg.
Figure 23:
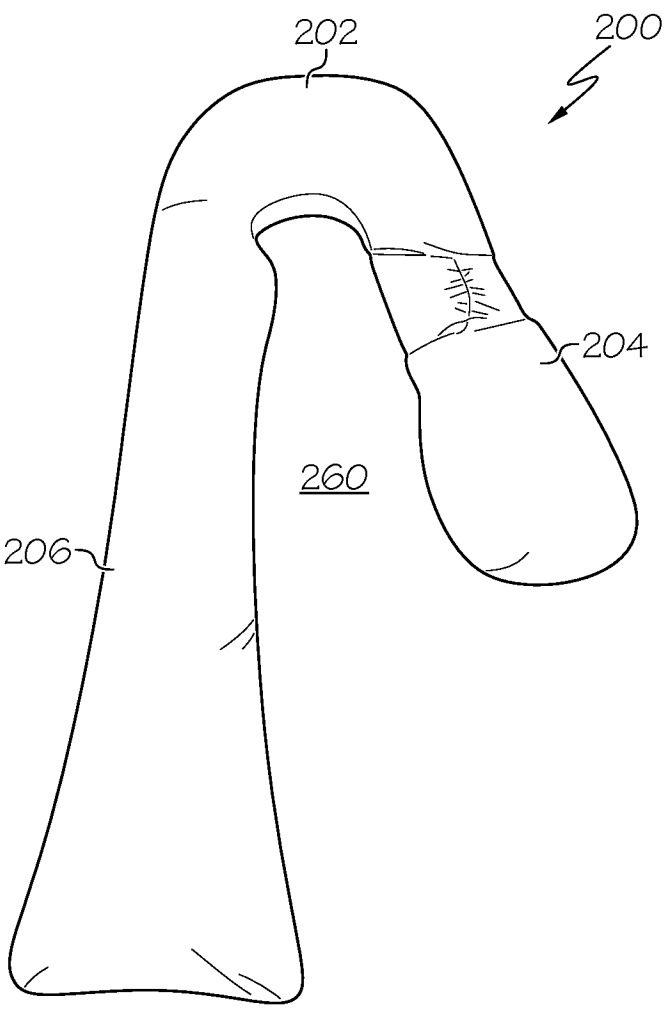
FIG. 23 shows the body pillow of FIG. 19 with the legs spread apart.

FIG. 19 depicts the pillow 200 in its resting position. FIGS. 23-26 illustrate four exemplary configurations. FIG. 23 shows the body pillow 200 of FIG. 19 with the legs spread apart slightly expanding the body receiving space 260 between the legs 204 and 206. FIG. 24 shows the body pillow 200 with the short (first) leg 204 turned inward so that the bulbous end 220 is received in the inner perimeter 234 of the second longer leg 206.

Figure 26:
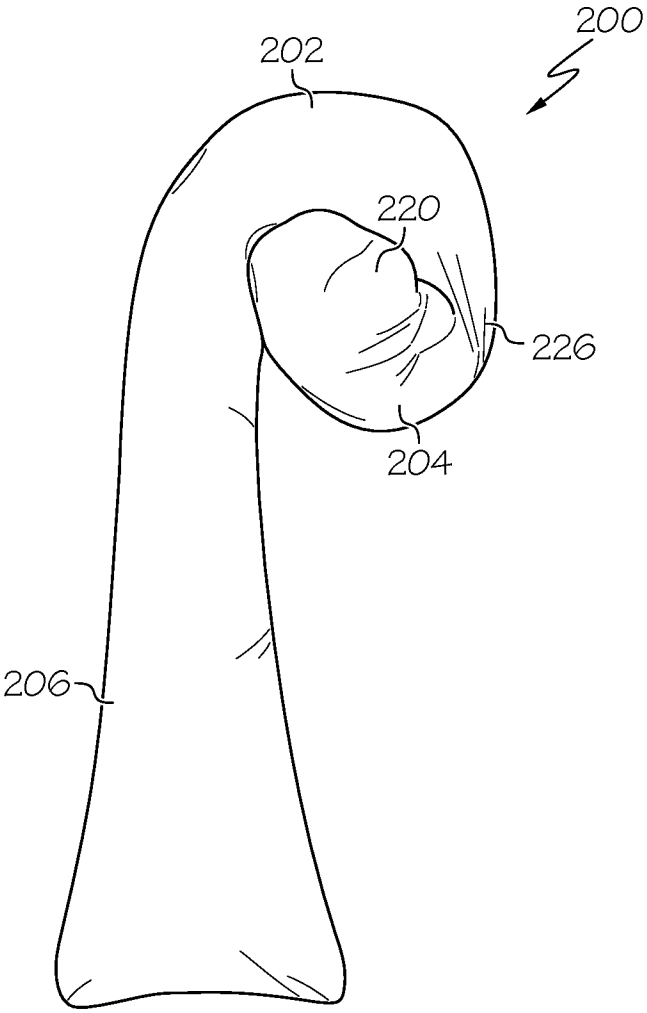
FIG. 26 shows the body pillow of FIG. 19 with the short leg curled inward tightly so that the bulbous end is received in the inner perimeter of the center section.
Figure 25:
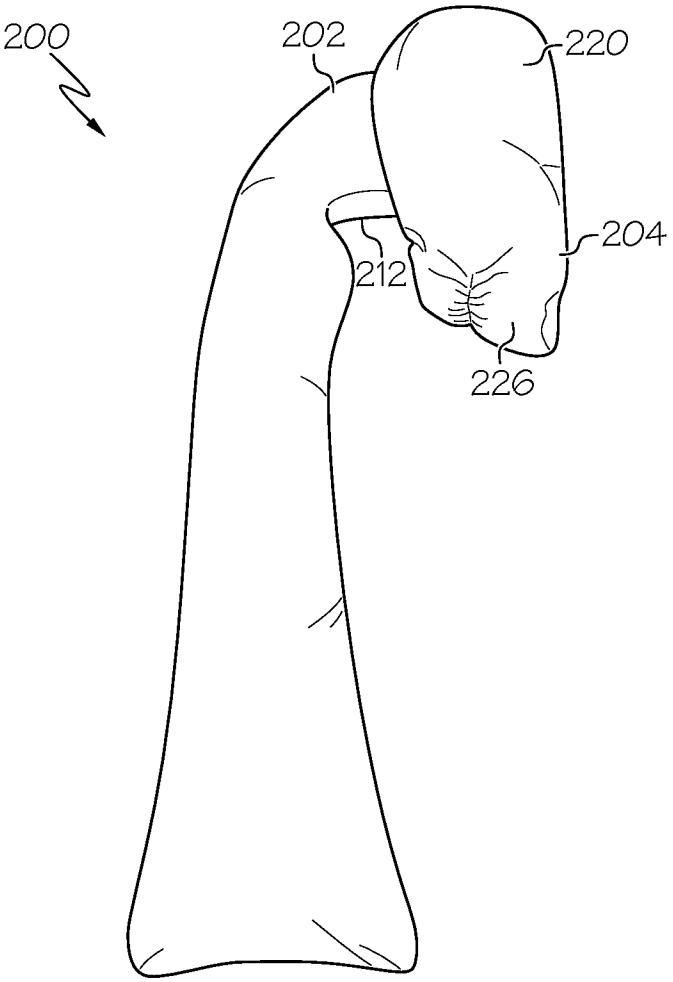
FIG. 25 shows the body pillow of FIG. 19 with the short leg folded over the top of the center section.

FIG. 25 shows the body pillow 200 with the short first leg 204 folded over the top of the center section 202 illustrating how the elasticized section 226 forms a highly bendable area or hinge or joint in the leg. FIG. 26 shows the body pillow 200 with the short leg 204 curled inward tightly so that the bulbous end 220 is received in the inner perimeter 212 of the center section 202. These drawings illustrate only some of the many configurations possible with the body pillow 200.

Figure 27:
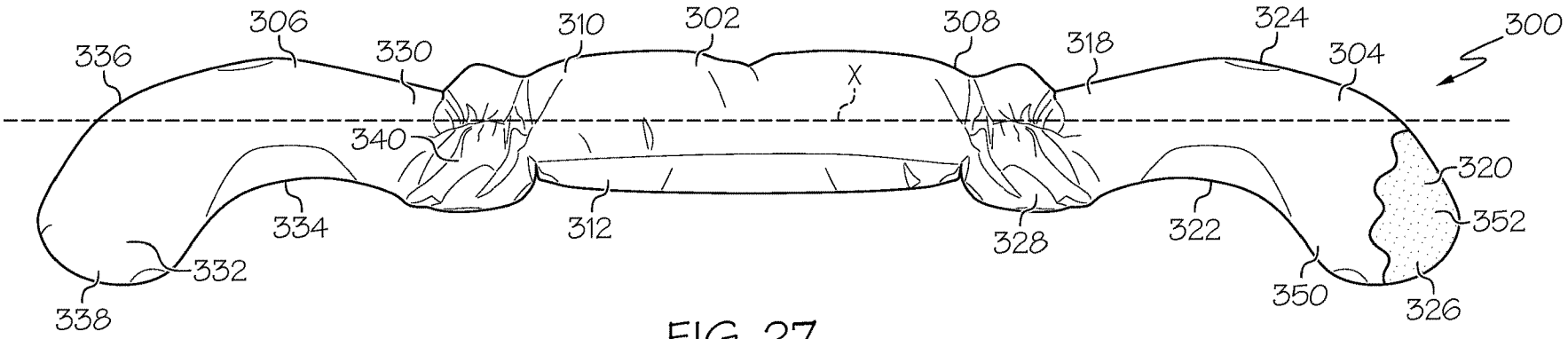
FIG. 27 is frontal perspective view of an adjustable body pillow made in accordance with another embodiment of the present invention. The pillow is shown in its resting position. The body pillow includes an elongate center section with two short curved legs. An elastic section is interposed between each leg and the respective end of the center section.

Referring now to FIG. 27, there is shown therein an adjustable body pillow made in accordance with another embodiment of the present invention and designated generally by the reference number 300. The body pillow 300, seen in its resting state in FIG. 27, generally comprises a center section 302, a first leg 304, and a second leg 306.

Figure 30:
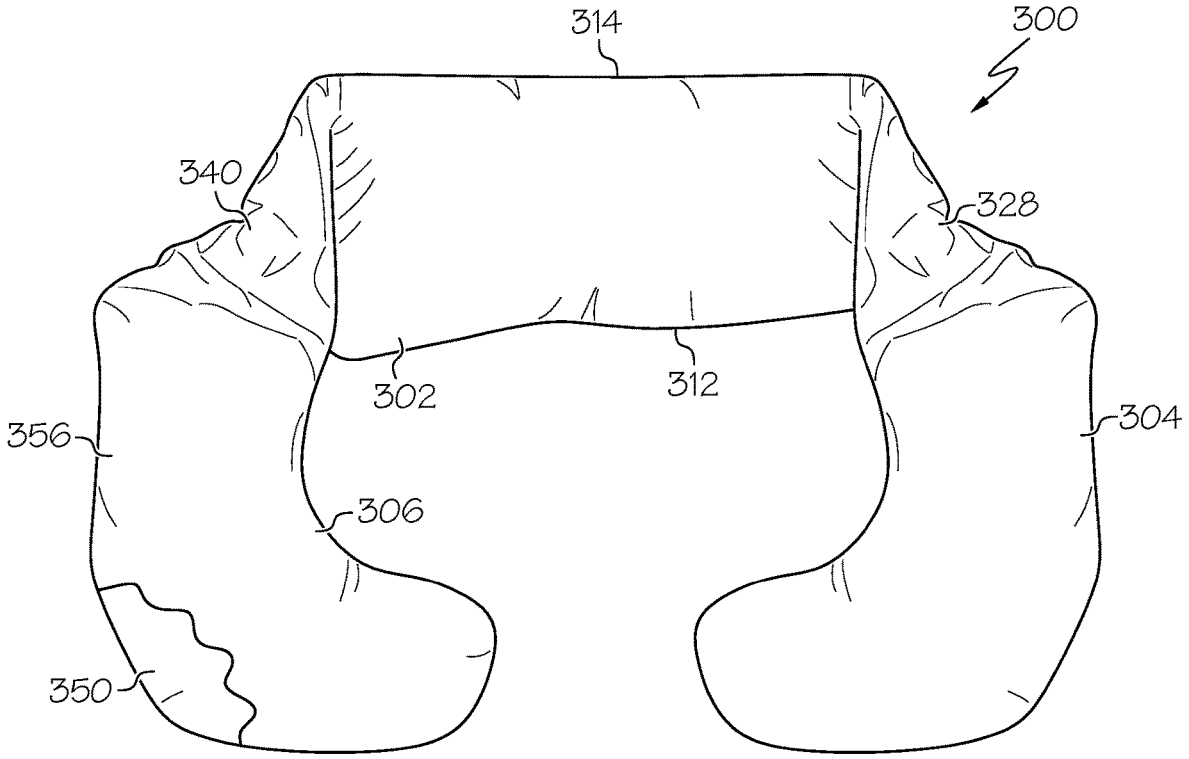
FIG. 30 is a frontal perspective view of the body pillow of FIG. 27 with the legs inverted by twisting the elasticized sections.

The center section 302 in this embodiment has a first end 308, a second end 310, an inner perimeter 312, and an outer perimeter 314 (see FIG. 30). Then center section 302 may be elongate and is generally straight along at least a portion of its length having a longitudinal axis X. Thus, the inner and outer perimeter 312 and 314 may be straight and parallel to each other. In the embodiment illustrated, the center section 302 is straight along its entire length, that is, from the first end 308 to the second end 310.

The first leg 304 has a first end 318, a second end 320, an inner perimeter 322, and an outer perimeter 324. The first leg 304 may form a curve and the second or free end 320 may terminate in an inwardly turned foot 326. An elasticized section 328 is included between the first end 308 of the center section 302 and the first end 318 of the first leg 304.

The second leg 306 has a first end 330, a second end 332, an inner perimeter 334, and an outer perimeter 336. The second leg 306 may form a curve and the second or free end 332 may terminate in an inwardly turned foot 338. An elasticized section 340 is included between the second end 310 of the center section 302 and the first end 330 of the second leg 306.

The contours and dimensions of the legs 304 and 306 may vary. Moreover, the contour and dimensions of the first leg 304 may be the same or may be different from the contour and dimensions of the second leg 306. In the embodiment shown in FIG. 27, the first and second legs 304 and 306 are similarly formed having the same overall dimensions and shape.

In the embodiment shown, the foot 326 of the first leg 304 and the foot 338 of the second leg 306 both curve inwardly relative to the longitudinal axis X of the center section 302 and in the same plane. The length of the center section 302 relative to the legs 304 and 306 may vary. In the embodiment shown, the length of the center section 302 is about the same as the length of the first and second legs 304 and 306.

Figure 28:
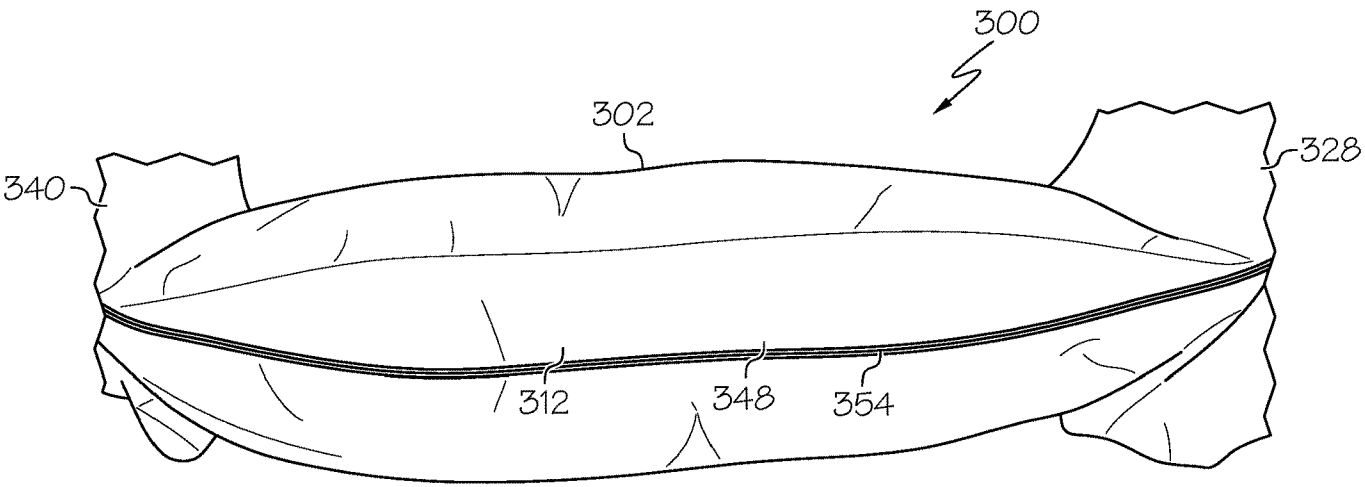
FIG. 28 is an enlarged, fragmented, frontal perspective view of the inner perimeter of the center section of the pillow of FIG. 27 showing the tension relief gusset.

The body pillow 300 may be constructed in a manner similar to the pillow 100 and 200 previously described. As shown in FIG. 28, the body pillow 300 may include a tension relief gusset 348 with a similar construction and for a similar purpose as the gusset 170 (FIGS. 6&7) described above for the body pillow 100. The gusset 348 extends across the inner perimeter 312 of the center section 302 between the first and second elasticized sections 328 and 340. As in the previous embodiments, the shape and dimensions of the gusset 348 may vary. In the embodiment shown, the gusset 348 tapers to a point at each end.

As in the previous embodiments, the pillow 300 may comprise a fabric enclosure 350 that contains a suitable filler as a compressible material 352. The body pillow 300 may include a zippered closure 354 similar to the previous embodiments. While the length and position of the zippered closure 354 may vary, one suitable position is along the lower border of the gusset 348. Similarly, the pillow 300 may include a shape-conforming removable cover 356 (FIG. 30) with an elasticized section, tension relief gusset, and zippered closure similar to those in the pillow 300.

Figure 29:
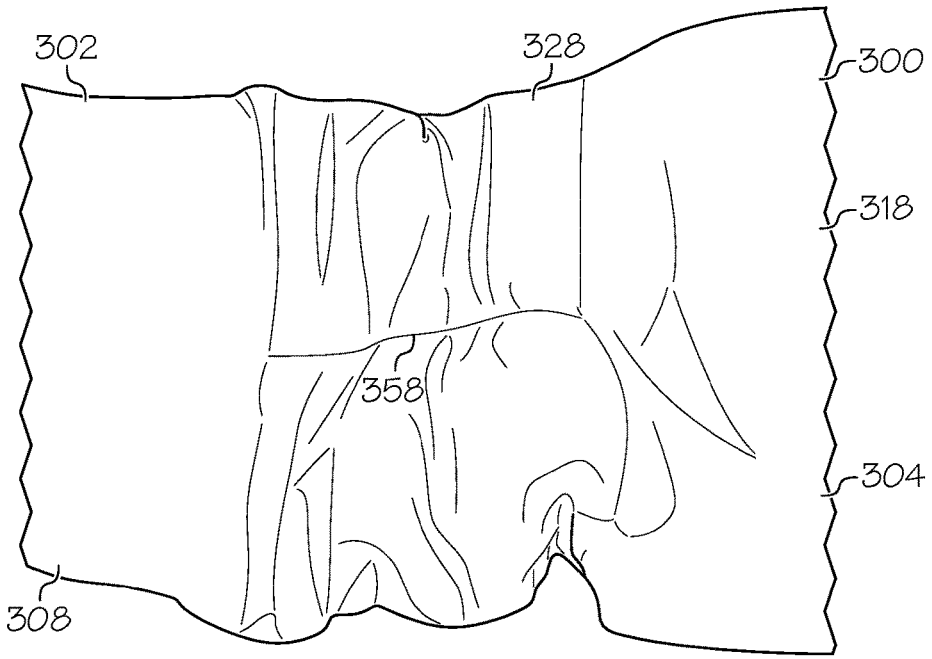
FIG. 29 is an enlarged, fragmented, side perspective view of one of the elasticized sections of the body pillow of FIG. 27.

The elasticized sections 328 and 340 are similarly formed to each other and to the elasticized sections of the previous embodiments, as illustrated by the enlarged view of the section 328 in FIG. 29. The relatively flat, compressed shape created by the seam 358 attaching the strip of elastic provides points at which the pillow 300 can be folded easily or twisted, as previously described. As shown in FIG. 30, in one configuration, both the first and second legs 304 and 306 are inverted in the same direction by twisting both the elasticized sections 328 and 340. It will be appreciated that either or both of the legs 304 and 306 may be inverted. Additionally, the legs 304 and 306 can be twisted in different directions.

Figure 31:
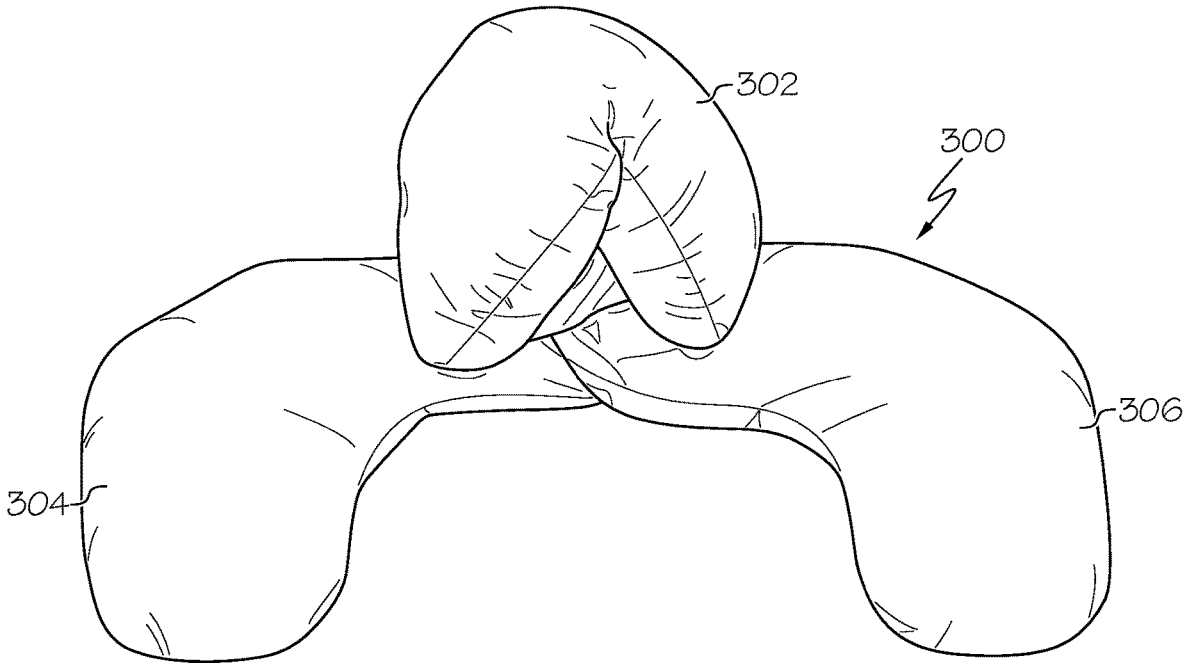
FIG. 31 is a frontal perspective view of the body pillow of FIG. 27 in another study pillow configuration. The center section is folded in half and legs are twisted together at the elasticized sections. This configuration serves as a study pillow; the folded center section provides back support, while the legs are positioned to support the user's forearms.

FIG. 31 illustrates another advantageous configuration for which the pillow 300 is particularly suited. The center section 302 is folded in half forming a loop placing the elasticized section 328 and 340 adjacent each other. Then, the elasticized sections 328 and 340 are twisted together. This configuration serves as a study pillow; the folded center section 302 provides firm back support, while the legs 304 and 306 are positioned to support the user's forearms. The three positions illustrated in FIGS. 27, 30, and 31 are illustrative and non-limiting examples of the various ways in which the pillow 300 can be configured.

The following issued US patents are incorporated herein by reference: (1) U.S. Pat. No. 7,793,371, entitled "Apparatus and Method for Question Mark-Shaped Body Pillow and Support System," issued Sep. 14, 2010; (2) U.S. Pat. No. 8,468,627, entitled "Elongated Angular Multiple Position Body Pillow," issued Jun. 25, 2013; (3) U.S. Pat. No. 7,010,821, entitled "Expandable Double Nursing Pillow," issued Mar. 14, 2006; (4) U.S. Pat. No. 7,353,552, entitled "Multiple Position Symmetrically Contoured Body Pillow," issued Apr. 8, 2008; (5) U.S. Pat. No. 6,499,164, entitled "Body Pillow With Horseshoe-Shaped Top and J-Shaped Bottom," issued Dec. 31, 2002; (6) U.S. Pat. No. 6,751,817, entitled "Contoured Body Pillow," issued Jun. 22, 2004; (7) U.S. Pat. No. 6,760,934, entitled "Symmetrically Contoured Support Pillow," issued Jul. 13, 2004; (8) U.S. Pat. No. 9,021,635, entitled "Body Pillow with Multiple Configurations," issued May 5, 2015. These patents describe the various techniques and materials related to the making of body pillows. The contents of U.S. Patent Application No. 62/460,892, entitled "Adjustable Body Pillow," filed Feb. 20, 2017, is incorporated herein by reference.

The embodiments shown and described above are exemplary. Many details are often found in the art and, therefore, many such details are neither shown nor described herein. It is not claimed that all of the details, parts, elements, or steps described and shown herein are newly invented. Changes may be made in the details, especially in matters of shape, size, and arrangement of the parts, within the principles of the invention to the full extent indicated by the broad meaning of the terms in the attached claims. The description and drawings of the specific embodiments herein do not point out what an infringement of this patent would be, but rather provide non-limiting examples of how to use and make the invention. Likewise, the abstract is neither intended to define the invention, which is measured by the claims, nor is it intended to be limiting as to the scope of the invention in any way. The limits of the invention and the bounds of the patent protection are measured by and defined in the following claims.

What is claimed is:

1. An adjustable body pillow comprising:

a center section having a first end, a second end, an inner perimeter, and an outer perimeter;

a first leg having a first end, a second end, an inner perimeter, an outer perimeter, an elasticized section between the first and the second end, wherein the first end is connected to the first end of the center section, and wherein the elasticized section is configured so that, when stretched, the distance between the first end of the center section and the second end of the first leg is expanded;

a second leg having a first end, a second end, an inner perimeter, and an outer perimeter, and wherein the first end is connected to the second end of the center section;

wherein the first and second legs both extend at an angle relative to the longitudinal axis of the center section in the same plane so that, when the body pillow is in the resting state, the inner perimeters of the center section and the first and second legs are continuous and together form a body receiving space.

2. The body pillow of claim 1 wherein the first and second legs are equal in length.

3. The body pillow of claim 2 wherein the elasticized section in the first leg is at the first end of the first leg.

4. A method for configuring the body pillow of claim 3 comprising:

adjusting the length of the first leg by stretching the elasticized section in the first leg; and adjusting the length of the second leg by stretching the elasticized section in the second leg.

5. The body pillow of claim 2 wherein the second leg includes an elasticized section between the first and the second end of the second leg and wherein the elasticized section in the second leg is configured so that, when stretched, the distance between the second end of the center section and the second end of the second leg is expanded.

6. The body pillow of claim 5 wherein the elasticized section in the second leg is at the first end of the second leg.

7. The body pillow of claim 6 wherein each of the first and second legs includes an inwardly extending bulge along the inner perimeter.

8. The body pillow of claim 7 wherein each of the first and second legs includes an inwardly turned toe on the second end.

9. The body pillow of claim 1 wherein the inner perimeter defines a semi-circle, wherein the outer perimeter of the center section forms a semi-circle and wherein the semi-circle formed by the inner perimeter of the center section and the semi-circle formed by the outer perimeter of the center section are concentric.

10. The body pillow of claim 1 wherein the second leg is longer than the first leg.

11. The body pillow of claim 10 wherein the second leg is about twice as long as the first leg.

12. The body pillow of claim 10 wherein the second end of the second leg is bell-shaped.

13. The body pillow of claim 10 wherein the second end of the first leg is bulbous.

14. The body pillow of claim 13 wherein the second leg includes an inwardly extending bulge along the inner perimeter at the first end of the second leg.

15. The body pillow of claim 14 further comprising a removable cover shaped to conform to the shape of the body pillow when the body pillow is in the resting position and wherein the cover includes an elasticized section corresponding to the elasticized section in the first leg.

16. A method for configuring the body pillow of claim 1 comprising:

adjusting the length of the first leg by stretching the elasticized section.

17. The body pillow of claim 1 further comprising a removable cover shaped to conform to the shape of the body pillow when the body pillow is in the resting position and wherein the cover includes an elasticized section corresponding to the elasticized section in the first leg.

18. A removable cover for an adjustable body pillow, wherein the cover is shaped to conform to the shape of the body pillow when the body pillow is in the resting position, wherein the body pillow comprises a center section having a first end, a second end, an inner perimeter, and an outer perimeter, a first leg having a first end, a second end, an inner perimeter, an outer perimeter, and an elasticized section between the first and the second end, a second leg having a first end, a second end, an inner perimeter, an outer perimeter, wherein the first and second legs both extend at an angle relative to the longitudinal axis of the center section in the same plane so that, when the body pillow is in the resting state, the inner perimeters of the center section and the first and second legs are continuous and together form a body receiving space, and wherein the cover further comprises:

a center section shaped to cover the center section of the body pillow;

a first leg shaped to cover the first leg of the body pillow and including an elasticized section corresponding to the elasticized section of the first leg of the body pillow; and a second leg shaped to cover the second leg of the body pillow.

19. The removable cover of claim 18 wherein the first and second legs of the body pillow are equal in length.

20. A pillow assembly comprising the removable cover of claim 18 and a body pillow comprising a center section, a first leg, and a second leg.

21. An adjustable body pillow comprising:

an elongate center section having a first end, a second end, an inner perimeter, an outer perimeter, and wherein the center section has a longitudinal axis;

a first leg having a first end, a second end, an inner perimeter, an outer perimeter, and wherein the second end of the first leg terminates in a foot;

a first elasticized section between the first end of the center section and the first end of the first leg, wherein the first elasticized section is configured so that, when stretched, the distance between the first end of the center section and the second end of the first leg is expanded;

a second leg having a first end, a second end, an inner perimeter, and an outer perimeter, and wherein the second end of the second leg terminates in a foot;

a second elasticized section between the second end of the center section and the first end of the second leg, wherein the second elasticized section is configured so that, when stretched, the distance between the second end of the center section and the second end of the second leg is expanded; and wherein the foot of each of the first and second legs curves inwardly relative to the longitudinal axis of the center section in the same plane.

22. The body pillow of claim 21 wherein the center section is straight from the first end to the second end.

23. The body pillow of claim 22 wherein the first and second legs are similarly formed and have the same length.

24. The body pillow of claim 23 wherein center section is about the same length as the first and second legs.

25. A method for configuring the body pillow of claim 21 comprising:

inverting the first leg by twisting the first elasticized section.

26. The method of claim 25 further comprising:

inverting the second leg by twisting the second elasticized section.

27. A method for configuring the body pillow of claim 21 comprising:

adjusting the length of the first leg by stretching the first elasticized section; and adjusting the length of the second leg by stretching the second elasticized section.

28. A removable cover for an adjustable body pillow, wherein the cover is shaped to conform to the shape of the body pillow when the body pillow is in the resting position, wherein the body pillow comprises an elongate center section having a first end, a second end, an inner perimeter, an outer perimeter, wherein the center section has a longitudinal axis, a first leg having a first end, a second end, an inner perimeter, and an outer perimeter, wherein the second end of the first leg terminates in a foot, a first elasticized section between the first end of the center section and the first end of the first leg, a second leg having a first end, a second end, an inner perimeter, and an outer perimeter, wherein the second end of the second leg terminates in a foot, a second elasticized section between the second end of the center section and the first end of the second leg, wherein the foot of each of the first and second legs curves inwardly relative to the longitudinal axis of the center section in the same plane, and wherein the cover further comprises:

a center section shaped to cover the center section of the body pillow;

a first leg shaped to cover the first leg of the body pillow;

a first elasticized section corresponding to the first elasticized section of the body pillow;

a second leg shaped to cover the second leg of the body pillow; and a second elasticized section corresponding to the second elasticized section of the body pillow.

29. A pillow assembly comprising the removable cover of claim 28 and a body pillow comprising a center section, a first leg, and a second leg.

30. The removable cover of claim 28 wherein the first and second legs of the body pillow are similarly formed and have the same length, wherein the center section is straight from the first end to the second end, and wherein the center section is longer than either of the first and second legs.

* * * * *